US012590578B2

(12) United States Patent
Kay et al.

(10) Patent No.: US 12,590,578 B2
(45) Date of Patent: Mar. 31, 2026

(54) FLUID END WITH TRANSITION SURFACE GEOMETRY

(71) Applicant: GD Energy Products, LLC, Tulsa, OK (US)

(72) Inventors: Konner Casey Kay, Broken Arrow, OK (US); Vadim Kachkovskiy, Spring Mills, PA (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 8 days.

(21) Appl. No.: 17/972,717

(22) Filed: Oct. 25, 2022

(65) Prior Publication Data

US 2024/0133373 A1 Apr. 25, 2024
US 2024/0229787 A9 Jul. 11, 2024

(51) Int. Cl.
*F04B 53/16* (2006.01)
*F04B 53/10* (2006.01)

(52) U.S. Cl.
CPC ..... *F04B 53/1087* (2013.01); *F04B 53/16* (2013.01)

(58) Field of Classification Search
None
See application file for complete search history.

(56) References Cited

U.S. PATENT DOCUMENTS 2,325,672 A 7/1943 Groff
2,816,515 A 12/1957 Senkowski et al.
5,701,872 A 12/1997 Kaku et al.
6,382,940 B1 5/2002 Blume
6,544,012 B1 4/2003 Blume
6,623,259 B1 9/2003 Blume
6,910,871 B1 * 6/2005 Blume ..... F04B 53/007 417/454
7,186,097 B1 3/2007 Blume
7,513,759 B1 4/2009 Blume
8,147,227 B1 4/2012 Blume
8,348,644 B2 1/2013 Tsutsumidani
(Continued)

FOREIGN PATENT DOCUMENTS

CA 2949708 C * 5/2021 ..... F04B 19/22
CN 106286181 A * 1/2017 ..... F03C 1/0463

OTHER PUBLICATIONS

Definition of Step (obtained from https://www.merriam-webster.com/dictionary/step on Dec. 14, 2024) (Year: 2024).*
(Continued)

*Primary Examiner* — Dominick L Plakkoottam
*Assistant Examiner* — Geoffrey S Lee
(74) *Attorney, Agent, or Firm* — Edell, Shapiro & Finnan, LLC

(57) ABSTRACT

A fluid end of a reciprocating pump includes multiple bores formed therein, and adjacent bores intersect each other. The intersection of two adjacent bores forms an intersection corner, which is where a concentration of high stress occurs during operation of the pump. A novel geometrical shape or geometry of the intersection corner reduces the concentration of stress on the intersection corners. By improving the shape and geometry of the intersection corner, the impact and concentration of the stress can be reduced, thereby improving or lengthening the lifetime of the material in that intersection corner of the fluid end.

20 Claims, 24 Drawing Sheets

(56) References Cited

U.S. PATENT DOCUMENTS

| | | | | |
|---|---|---|---|---|
| 8,784,081 | B1 * | 7/2014 | Blume | F04B 53/22 417/559 |
| 8,894,392 | B1 * | 11/2014 | Blume | F04B 53/16 137/512 |
| 8,915,722 | B1 | 12/2014 | Blume | |
| 9,188,121 | B1 | 11/2015 | Dille | |
| 9,297,375 | B1 * | 3/2016 | Dille | F04B 53/16 |
| 9,383,015 | B2 * | 7/2016 | Cary | F16J 10/02 |
| 9,416,887 | B2 | 8/2016 | Blume | |
| 9,435,454 | B2 | 9/2016 | Blume | |
| 9,732,746 | B2 | 8/2017 | Chandrasekaran et al. | |
| 10,273,954 | B2 * | 4/2019 | Brown | F04B 1/0448 |
| 10,302,078 | B2 * | 5/2019 | Hiller | F04B 53/16 |
| 10,337,508 | B2 * | 7/2019 | Cary | F04B 53/14 |
| 10,731,643 | B2 | 8/2020 | DeLeon, II | |
| 10,907,632 | B2 * | 2/2021 | Morreale | F16K 27/0209 |
| 10,941,866 | B2 | 3/2021 | Nowell et al. | |
| 11,181,108 | B2 | 11/2021 | Brooks et al. | |
| 11,346,340 | B2 | 5/2022 | Deleon, II | |
| 2005/0200081 | A1 | 9/2005 | Stanton et al. | |
| 2008/0282879 | A1 * | 11/2008 | Arnold | F04B 53/16 417/559 |
| 2012/0288387 | A1 * | 11/2012 | Freed | F04B 53/16 417/454 |
| 2014/0345452 | A1 * | 11/2014 | Cary | F16L 41/03 92/169.1 |
| 2017/0146011 | A1 * | 5/2017 | Hiller | F04B 53/14 |
| 2017/0159655 | A1 * | 6/2017 | Morreale | F16K 15/026 |
| 2019/0072089 | A1 | 3/2019 | Buckley | |
| 2019/0154033 | A1 * | 5/2019 | Brooks | F16K 15/026 |
| 2019/0242373 | A1 * | 8/2019 | Wernig | F04B 1/0404 |
| 2019/0247957 | A1 * | 8/2019 | Stribling | B24C 1/10 |
| 2020/0355182 | A1 | 11/2020 | DeLeon, II | |
| 2023/0167817 | A1 | 6/2023 | Hurst et al. | |
| 2023/0407852 | A1 * | 12/2023 | Avey | F04B 17/00 |

OTHER PUBLICATIONS

Definition of Hemisphere (obtained from https://www.merriam-webster.com/dictionary/hemisphere on Dec. 14, 2024) (Year: 2024).*

Definition of foci of an ellipse (obtained from https://www.mathwords.com/f/foci_ellipse.htm on Dec. 14, 2024) (Year: 2024).*

Definition of Smooth (Obtained from https://www.merriam-webster.com/dictionary/smooth on Dec. 14, 2024) (Year: 2024).*

* cited by examiner

FLUID END WITH TRANSITION SURFACE GEOMETRY

FIELD OF INVENTION

The present invention relates to the field of high pressure reciprocating pumps and, in particular, to fluid ends of high pressure reciprocating pumps and the surfaces between intersecting bores in the fluid ends.

BACKGROUND

High pressure reciprocating pumps are often used to deliver high pressure fluids during earth drilling operations. A reciprocating pump includes a fluid end that defines several different internal bores, adjacent ones of which intersect. In fluid ends with intersecting bores, the corners of where the bores intersect are typically stress concentration points. High stresses are due to the internal pressure in the pump and the fluid that is being pumped. The concentration of stress on the intersection corners negatively impacts the fatigue life of a pump fluid end and the quality of the finished fluid end housing or casing. It is typical practice to hand grind in a transitional radius at that intersecting corner to try to reduce the stress at the corner.

To lengthen the lifetime of the fluid end of a reciprocating pump, there is a need to improve the corners of intersecting bores in the fluid end.

SUMMARY

The present application relates to a fluid end of a reciprocating pump that includes a housing defining a first bore, a second bore that intersects with the first bore at a first intersection corner, a third bore that intersects with the second bore at a second intersection corner, and a fourth bore that intersects with the third bore at a third intersection corner. The fourth bore also intersects with the first bore at a fourth intersection corner, each of the first bore, the second bore, the third bore, and the fourth bore is in fluid communication with a cross-bore, wherein the first intersection corner defines a first transition area having a first surface, and the fourth intersection corner defines a fourth transition area having a fourth surface, wherein a hemisphere profile overlaps the first intersection corner, the fourth intersection corner, the first transition area surface, and the fourth transition area surface.

The present invention also relates to a fluid end of a reciprocating pump that includes a housing defining a first bore, a second bore that intersects with the first bore at a first intersection corner. The first intersection corner defines a first transition area having a first surface, the first bore has a hemisphere profile overlapping the first intersection corner, and the second bore includes one of a stepped transition feature at the first intersection corner or an overlapping feature with the hemisphere profile. In addition, the fluid end may include a third bore intersecting with the second bore at a second intersection corner, and a fourth bore intersecting with the third bore at a third intersection corner, the fourth bore also intersects with the first bore at a fourth intersection corner, each of the first bore, the second bore, the third bore, and the fourth bore is in fluid communication with a cross-bore, the fourth intersection corner defines a fourth transition area having a fourth surface, and the hemisphere profile also overlaps the fourth intersection corner, the first transition area surface, and the fourth transition area surface.

In an alternative embodiment, each of the first bore, the second bore, the third bore, and the fourth bore has a centerline, the hemisphere profile has a center point, and the center point is located at the intersection of the first bore centerline and the second bore centerline and at the intersection of the first bore centerline and the fourth bore centerline. Alternatively, the hemisphere profile has a radius, and the radius intersects each of the first transition area surface and the fourth transition area surface. Each of the first transition area surface and the fourth transition area surface is a machined surface.

In another embodiment, the hemisphere profile is a first hemisphere profile, the second intersection corner defines a second transition area having a second surface, and the third intersection corner defines a third transition area having a third surface, wherein a second hemisphere profile overlaps the second intersection corner, the third intersection corner, the second transition area surface, and the third transition area surface. The second hemisphere profile has a radius, and the radius of the second hemisphere profile intersects each of the second transition area surface and the third transition area surface. In one embodiment, the radius of the second hemisphere profile is the same as a radius of the first hemisphere profile. In another embodiment, the radius of the second hemisphere profile is different from a radius of the first hemisphere profile. The first hemisphere profile is located on a bottom side of the cross-bore, and the second hemisphere profile is located on a top side of the cross-bore.

In a different embodiment, one of the first bore and the second bore includes a transition or stepped transition feature, the transition feature intersects approximately tangentially to the hemisphere profile, and the transition feature forms a substantially smooth transition at the first intersection corner. The one of the first bore and the second bore has a first portion with an inner surface having a first inner diameter and a second portion with an inner surface having a second inner diameter, the transition feature includes a radiused transition located between the first and second portions, and the first inner diameter is different from the second inner diameter. In some embodiments, the radiused transition includes a first radiused surface, a second radiused surface, and an angled surface between the first radiused surface and the second radiused surface. The radiused transition includes a first radiused surface adjacent to a second radiused surface.

In yet another embodiment, a fluid end of a reciprocating pump includes a housing defining a first bore, a second bore intersecting with the first bore at a first intersection corner defining a first transition area, a third bore intersecting with the second bore at a second intersection corner defining a second transition area, and a fourth bore intersecting with the third bore at a third intersection corner defining a third transition area, the fourth bore also intersecting with the first bore at a fourth intersection corner defining a fourth transition area, each of the first transition area, the second transition area, the third transition area, and the fourth transition area including its own surface, wherein a first hemisphere profile overlaps the first intersection corner, the fourth intersection corner, the first transition area surface, and the fourth transition area surface, and a second hemisphere profile overlaps the second intersection corner, the third intersection corner, the second transition area surface, and the third transition area surface.

In an alternative embodiment, each of the first bore, the second bore, the third bore, and the fourth bore has a centerline, the first hemisphere profile has a first center point located at the intersection of the first bore centerline and the second bore centerline and at the intersection of the first bore centerline and the fourth bore centerline, and the second hemisphere profile has a second center point located at the intersection of the second bore centerline and the third bore centerline and at the intersection of the third bore centerline and the fourth bore centerline. The first hemisphere profile has a first radius and the second hemisphere profile has a second radius, and the first radius is equal to the second radius. Additionally, each of the first bore, the second bore, the third bore, and the fourth bore is in fluid communication with a cross-bore, the first hemisphere profile has a first radius and is located on a bottom side of the cross-bore, the second hemisphere profile has a second radius and is located on a top side of the cross-bore, the first radius is smaller the second radius, and the first hemisphere profile is smaller than the second hemisphere profile.

In another embodiment, a reciprocating pump includes a housing defining a first bore, a second bore intersecting with the first bore at a first intersection corner defining a first transition area, a third bore intersecting with the second bore at a second intersection corner defining a second transition area, and a fourth bore intersecting with the third bore at a third intersection corner defining a third transition area, the fourth bore also intersecting with the first bore at a fourth intersection corner defining a fourth transition area, each of the first bore, the second bore, the third bore, and the fourth bore is in fluid communication with a cross-bore, the cross-bore having a top side and a bottom side, wherein a hemisphere profile overlaps the first transition area and the fourth transition area, and the hemisphere profile is located on the bottom side of the cross-bore, and a plunger reciprocally movable in the second bore of the housing.

In an alternative embodiment, the hemisphere profile is a first hemisphere profile, a second hemisphere profile overlaps the second intersection area and the third intersection area, and the second hemisphere profile is located on a top side of the cross-bore. A radius of the second hemisphere profile is different from a radius of the first hemisphere profile.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a fluid end of a reciprocating pump. Each of the different embodiments of fluid ends presented herein have multiple bores formed therein, and adjacent bores intersect each other. The intersection of two adjacent bores forms an intersection corner, which is where a concentration of high stress occurs during operation of the pump. The particular shape and geometry of the intersection corner determines the impact of the stress and the level of concentration of stress on the intersection corner. By improving the shape and geometry of the intersection corner, the impact and concentration of the stress can be reduced, thereby improving or lengthening the lifetime of the material in that intersection corner of the fluid end.

In this invention, a novel geometry approach is used to reduce the stress at one or more of the intersection corners. The particular geometry or geometrical approach used is a hemisphere or partial sphere geometry. There are two ways or methods to create the hemisphere or partial sphere geometry inside the fluid end. One method is to utilize hand finishing to form the various surfaces that are described herein. An alternative method is to utilize machining tools instead of hand finishing. Either of those methods can used depending on resource availability. In addition, a combination of machine finishing and hand finishing can be performed on a fluid end. When a machine operation is performed, the need to hand grind a transition radius for a cross-bore (also referred to as a pumping chamber) in the fluid end is reduced. In some instances, the reduction in stress achieved by a machine finish process is greater than that achieved via a hand finished radius process. By reducing the amount of hand finishing required at the fluid end cross-bore, the result is a more consistent finished product.

This novel hemisphere or partial sphere geometry can be applied to any intersection of two overlapping bores at the intersecting corners between them. The new geometry reduces the stresses at the corners created by two intersecting bores, thereby improving the operating stress of the quadrants in the fluid end and the fatigue life compared to current geometries.

Figure 1:
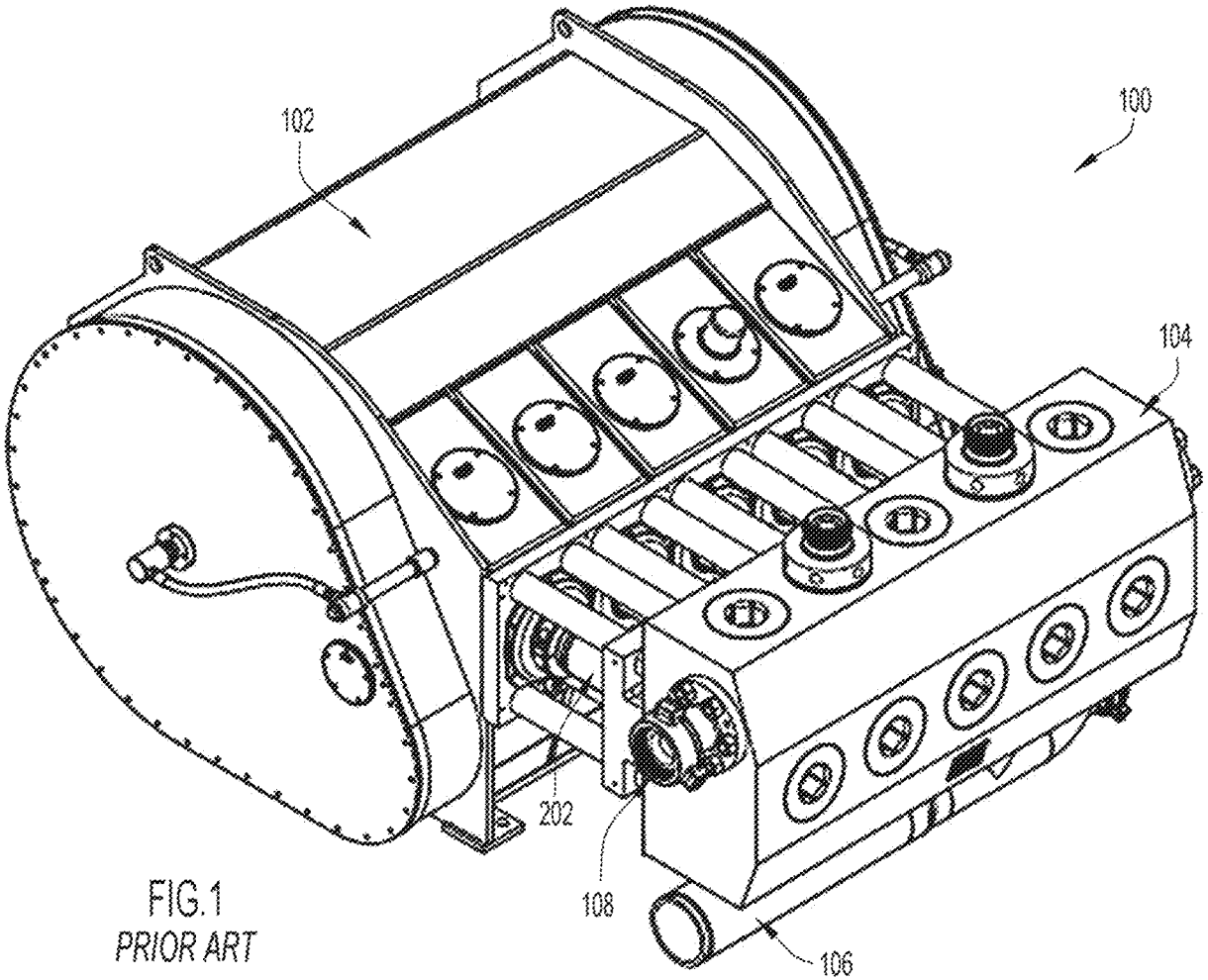
FIG.1 PRIOR ART
FIG. 1 is a perspective view of a prior art reciprocating pump including a fluid end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

Figure 2:
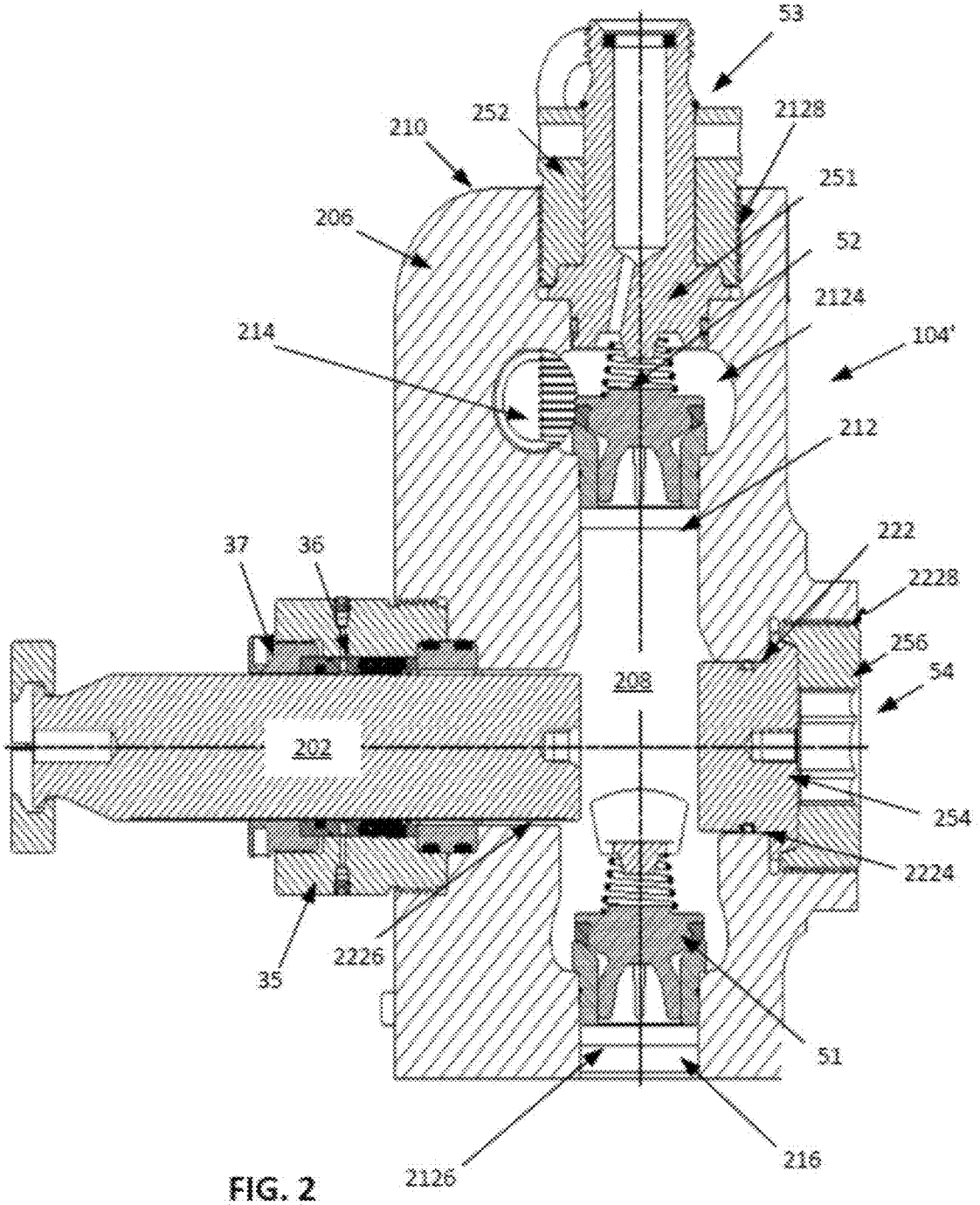
FIG. 2 (PRIOR ART)
FIG. 2 is a side cross-sectional view of a fluid end of another prior art reciprocating pump.

Still referring to FIG. 1, but now in combination with FIG. 2, in various embodiments, the fluid end 104 may be shaped differently and/or have different features, but may still generally perform the same functions, define similar structures, and house similar components. To illustrate potential shape variations, FIG. 2 shows a side, cross-sectional view of a fluid end 104' with different internal and external shaping as compared to fluid end 104. However, since fluid end 104 and fluid end 104' have many operational similarities, FIGS. 1 and 2 are labeled with the same reference numerals and are both described with respect to these common reference labels.

The cross-sectional view of FIG. 2 is taken along a central or plunger axis of one of the plungers 202 included in reciprocating pump 100. Thus, although FIG. 2 depicts a single pumping chamber 208, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a plunger 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the plunger 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100.

As can be seen in FIG. 2, the pumping paths and pumping chamber 208 of the fluid end 104' are formed by conduits that extend through the casing 206 to define openings at an external surface 210 of the casing 206. More specifically, a first conduit 212 extends longitudinally (e.g., vertically) through the casing 206 while a second conduit 222 extends laterally (e.g., horizontally) through the casing 206. Thus, conduit 212 intersects conduit 222 to at least partially (and collectively) define the pumping chamber 208. In the prior art fluid end 104 and prior art fluid end 104', conduits 212 and 222 are substantially cylindrical, but the diameters of conduit 212 and conduit 222 may vary throughout the casing 206 so that conduits 212 and 222 can receive various structures, such as sealing assemblies or components thereof.

Regardless of the diameters of conduit 212 and conduit 222, each conduit may include two segments, each of which extends from the pumping chamber 208 to the external surface 210 of the casing 206 and may also be referred to as a bore. Specifically, conduit 212 includes a first segment 2124 and a second segment 2126 that opposes the first segment 2124. Likewise, conduit 222 includes a third segment 2224 and a fourth segment 2226 that opposes the third segment 2224. In the illustrated embodiment, the segments of a conduit (e.g., segments 2124 and 2126 or segments 2224 and 2226) are substantially coaxial while the segments of different conduits are substantially orthogonal. However, in other embodiments, segments 2124, 2126, 2224, and 2226 may be arranged along any desired angle or angles, for example, to intersect pumping chamber 208 at one or more non-straight angles.

In this embodiment, conduit 212 defines a fluid path through the fluid end 104. Segment 2126 is an intake segment that connects the pumping chamber to a piping system 106 delivering fluid to the fluid end 104. Meanwhile, segment 2124 is an outlet or discharge segment that allows compressed fluid to exit the fluid end 104. Thus, in operation, segments 2126 and 2124 may include valve components 51 and 52, respectively, (e.g., one-way valves) that allow segments 2126 and 2124 to selectively open. Typically, valve components 51 in the inlet segment 2126 may be secured therein by a piping system 106 (see FIG. 1). Meanwhile valve components 52 in outlet segment 2124 may be secured therein by a closure assembly 53 that, in the prior art example illustrated in FIG. 2, includes a closure element 251 (also referred to as a discharge plug) that is secured in the segment 2124 by a retaining assembly 252. Notably, the prior art retaining assembly 252 is coupled to segment 2124 via threads 2128 defined by an interior wall of segment 2124.

On the other hand, segment 2226 defines, at least in part, a cylinder for plunger 202, and/or connects the casing 206 to a cylinder for plunger 202. For example, in the illustrated embodiment, a casing segment 35 is secured to segment 2226 and houses a packing assembly 36 configured to seal against a plunger 202 disposed interiorly of the packing assembly 36. In any case, reciprocation of a plunger 202 in or adjacent to segment 2226, which may be referred to as a reciprocation segment, draws fluid into the pumping chamber 208 via inlet segment 2126 and pumps the fluid out of the pumping chamber 208 via outlet segment 2124. Notably, in the illustrated prior art arrangement, the packing assembly 36 is retained within casing segment 35 with a retaining element 37 that is threadedly coupled to casing segment 35.

Segment 2224 is an access segment that can be opened to access to parts disposed within casing 206 and/or surfaces defined within casing 206. During operation, access segment 2224 may be closed by a closure assembly 54 that, in the prior art example illustrated in FIG. 2, includes a closure element 254 (also referred to as a suction plug) that is secured in the segment 2224 by a retaining assembly 256. Notably, the prior art retaining assembly 256 is coupled to segment 2224 via threads 2228 defined by an interior wall of segment 2224. However, in some embodiments, conduit 222 need not include segment 2224 and conduit 222 may be formed from a single segment (segment 2226) that extends from the pumping chamber 208 to the external surface 210 of casing 206.

Overall, in operation, fluid may enter fluid end 104 (or fluid end 104') via multiple openings, as represented by opening 216 in FIG. 2, and exit fluid end 104 (or fluid end 104') via multiple openings, as represented by opening 214 in FIG. 2. In at least some embodiments, fluid enters openings 216 via pipes of piping system 106, flows through pumping chamber 208 (due to reciprocation of a plunger 202), and then flows through openings 214 into a channel 108. However, piping system 106 and channel 108 are merely example conduits and, in various embodiments, fluid end 104 may receive and discharge fluid via any number of pipes and/or conduits, along pathways of any desirable size or shape.

Also, during operation of pump 100, the first segment 2124 (of conduit 212), the third segment 2224 (of conduit 222), and the fourth segment 2226 (of conduit 222) may each be "closed" segments. By comparison, the second segment 2126 (of conduit 212) may be an "open" segment that allows fluid to flow from the external surface 210 to the pumping chamber 208. That is, for the purposes of this application, a "closed" segment may prevent, or at least substantially prevent, direct fluid flow between the pumping chamber 208 and the external surface 210 of the casing 206 while an "open" segment may allow fluid flow between the pumping chamber 208 and the external surface 210. To be clear, "direct fluid flow" requires flow along only the segment so that, for example, fluid flowing from pumping chamber 208 to the external surface 210 along segment 2124 and channel 108 does not flow directly to the external surface 210 via segment 2124.

Figure 3:
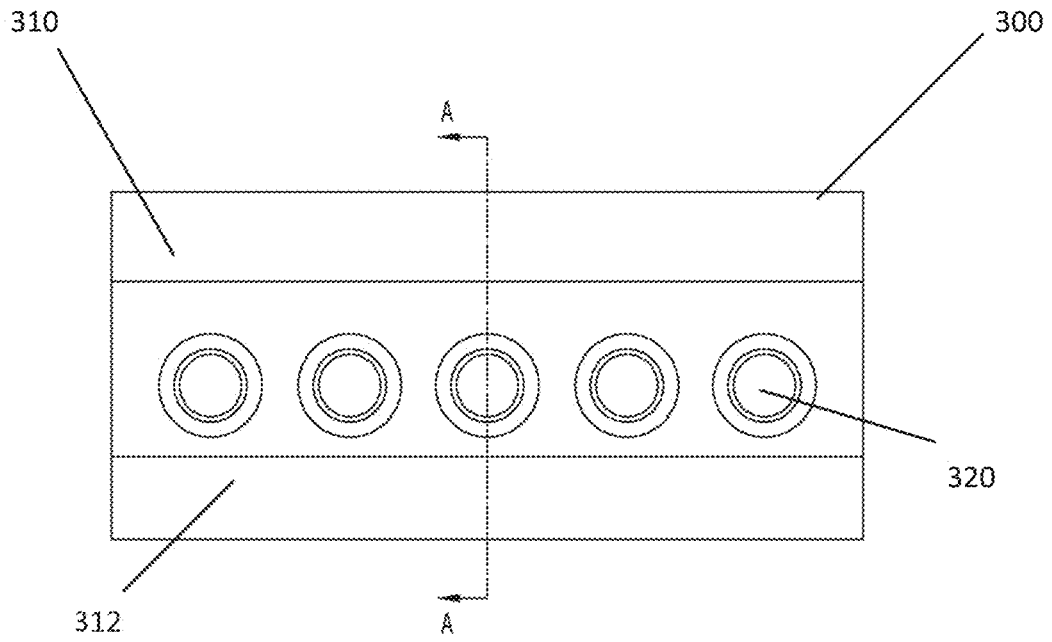
FIG. 3 is a plan view of a fluid end of a reciprocating pump according to the present invention looking into the access bores of the fluid end.
Figure 4:
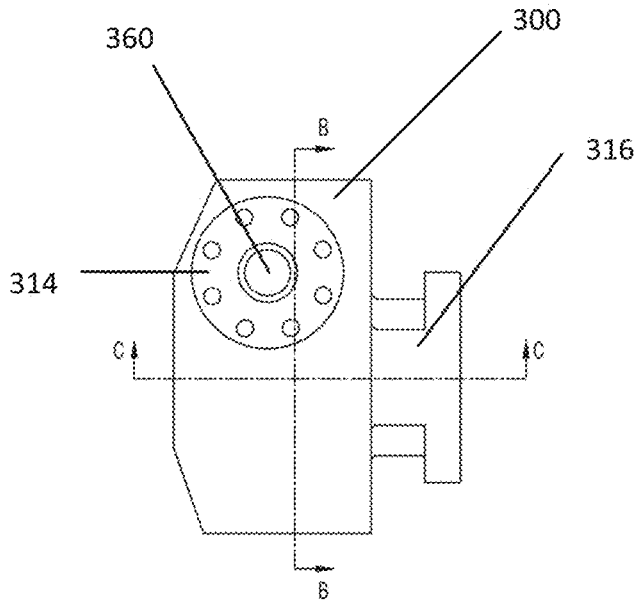
FIG. 4 is an end view of the fluid end illustrated in FIG. 3.

Now turning to FIGS. 3 and 4, plan and side views of an exemplary embodiment of a fluid end according to the present application are illustrated. In this embodiment, fluid end 300 includes a casing or housing 310 that has an outer surface 312. As shown in FIG. 3, the fluid end 300 has several plunger bores 320. It can be appreciated that the fluid end 300 may include any number of plunger bores 320 in different embodiments, and should not be limited to only five plunger bores 320 as illustrated in FIG. 3. Additionally or alternatively, the outer surface 312 of the fluid end casing 310 can have any number of shapes or features, as mentioned above in connection with the prior art of FIGS. 1 and 2. For example, in other embodiments, the outer surface 312 of the fluid end casing 310 might be flangeless. As shown in the side view illustrated in FIG. 4, the fluid end 300 includes an inlet end 314 and a power end 316. The inlet end 314 defines an inlet bore 360. Examples of pump fluid ends are disclosed in U.S. Pat. Nos. 9,383,015 and 10,337,508, the disclosures of which are incorporated by reference herein in their entirety.

Figure 5:
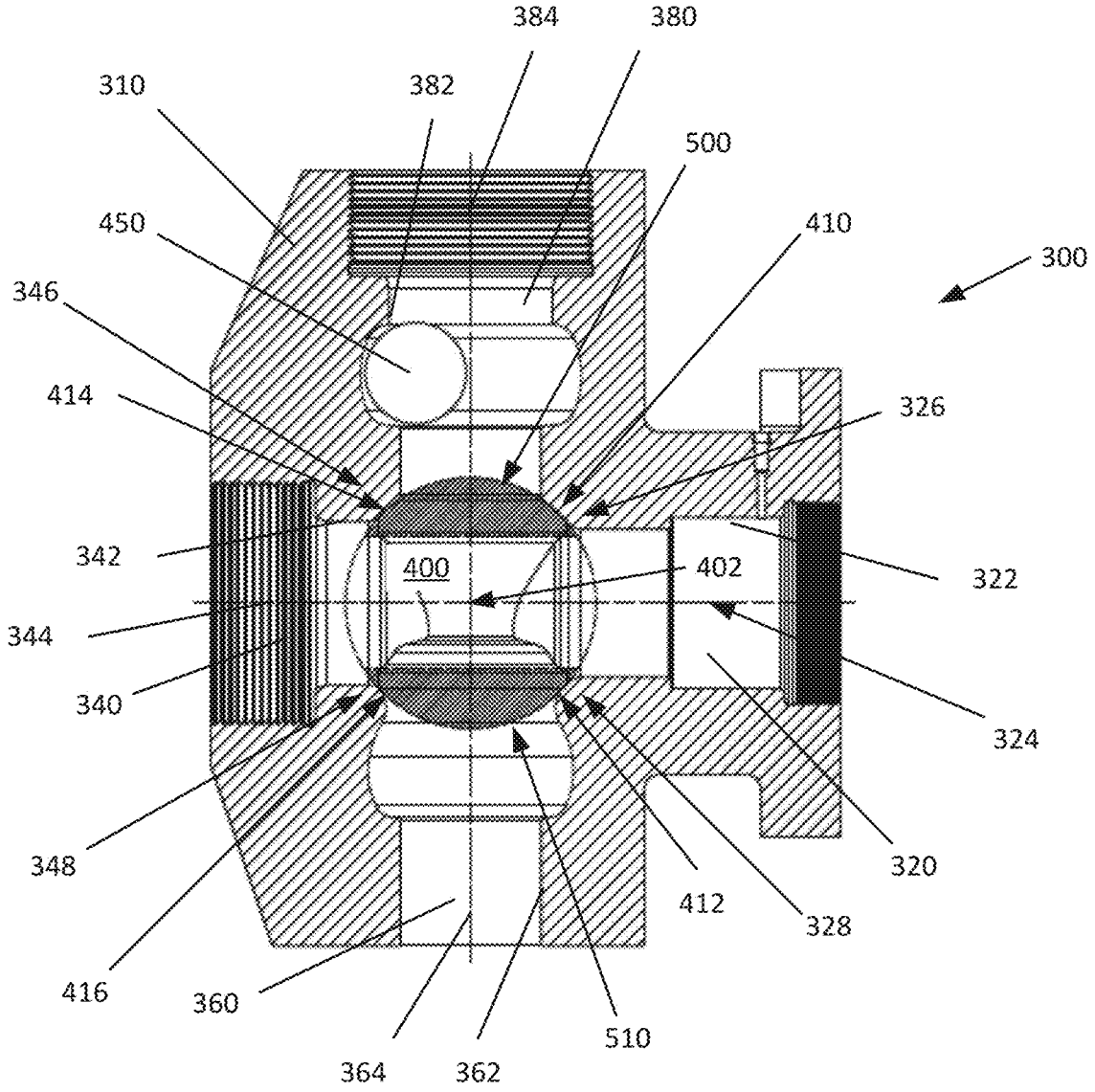
FIG. 5 is a side cross-sectional view of the fluid end illustrated in FIG. 3 taken along line "A-A".
Figure 6:
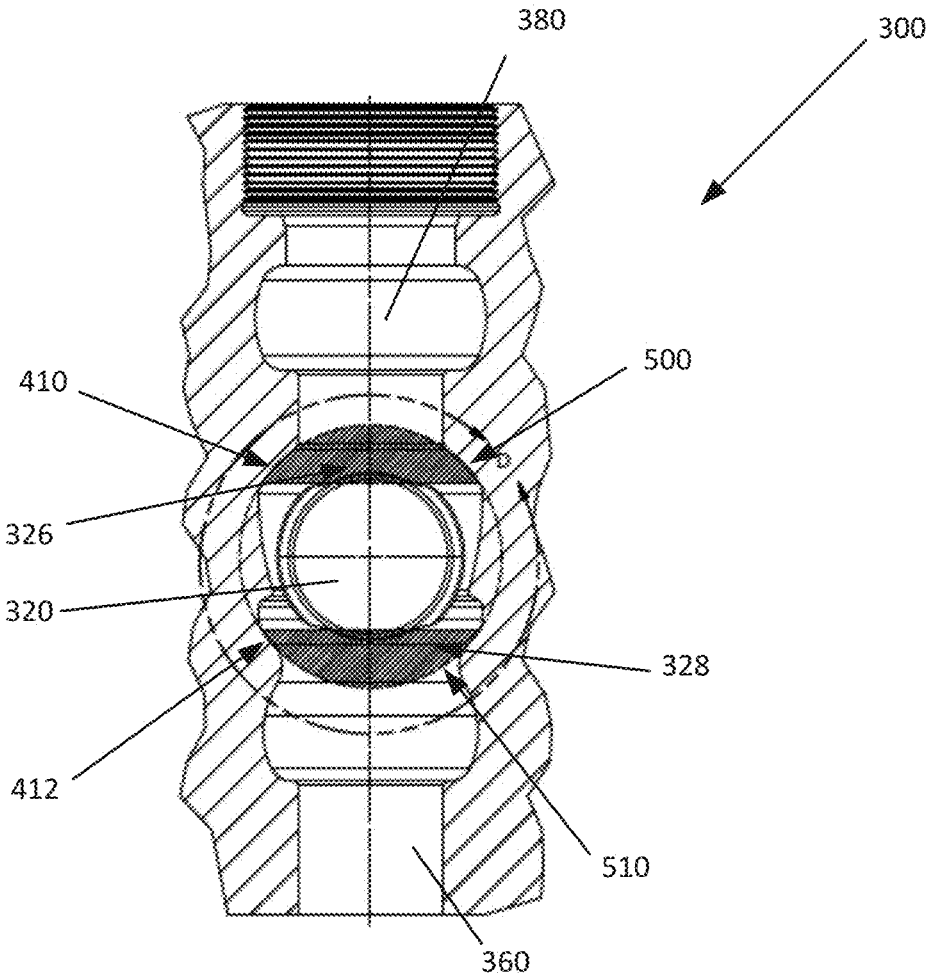
FIG. 6 is a plan cross-sectional view of the fluid end illustrated in FIG. 4 taken along line "B-B".
Figure 7:
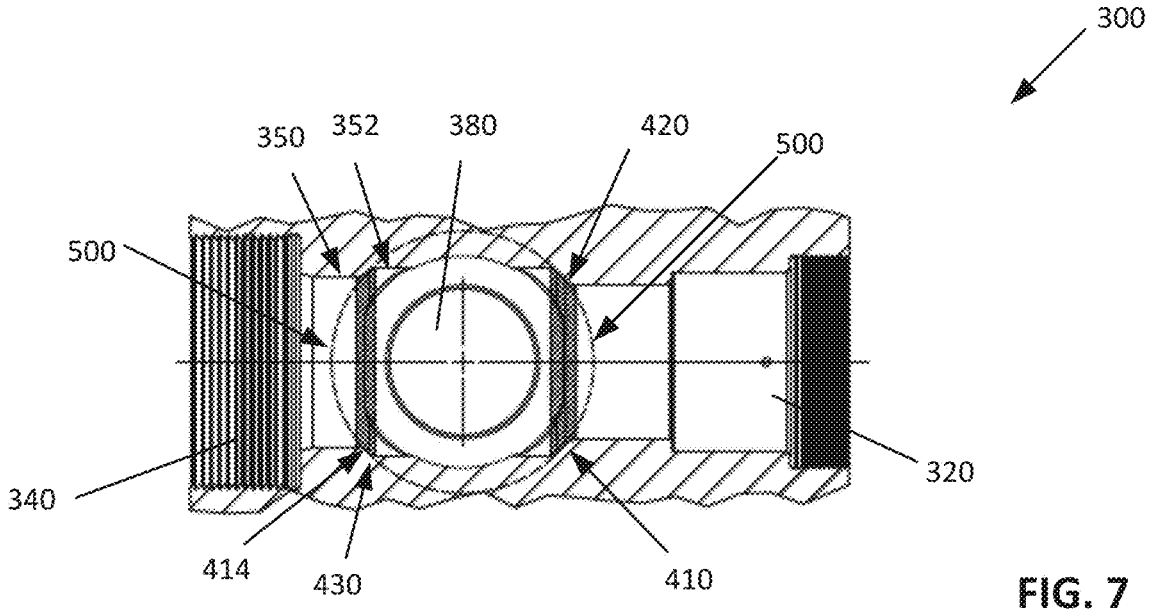
FIG. 7 is a bottom cross-sectional view of the fluid end illustrated in FIG. 4 taken along line "C-C".

Each of FIGS. 3 and 4 includes one or more cross-sectional lines that define the views illustrated in subsequent FIGS. Line "A-A" defines the side cross-sectional view illustrated in FIG. 5, line "B-B" defines the plan cross-sectional view illustrated in FIG. 6, and line "C-C" defines the bottom cross-sectional view illustrated in FIG. 7. Similar cross-sectional views for additional embodiments of pump fluid ends disclosed herein utilize similar cross-sectional lines to those shown in FIGS. 3 and 4.

Referring to FIG. 5, a side cross-sectional view of the fluid end 300 illustrated in FIG. 3 taken along line "A-A" is illustrated. In this view, the valve components and closure and retaining assemblies have been removed from the fluid end 300 to facilitate the description thereof. The casing or housing 310 of fluid end 300 includes a plunger or power end bore 320 that is a bore for a plunger. The plunger bore 320 has an inner wall 322 that defines the bore 320. The plunger bore 320 also has a plunger axis or centerline 324 that extends therethrough. The casing 310 includes a valve cover or access bore 340 which is defined by an inner surface 342 and has a centerline or axis 344. Valve cover bore 340 includes a threaded region for the mounting of various fluid end components, but other embodiments need not include threads. In this embodiment, centerline 344 of bore 340 is aligned with centerline 324 of bore 320; but these bores need not always be aligned.

The fluid end casing 310 also includes an inlet bore 360 that is defined by an inner surface 362 and has a centerline or axis 364. The casing 310 also includes a discharge bore 380 that is defined by an inner surface 382 and a centerline or axis 384. The discharge bore 380 includes a threaded region for the mounting of various fluid end components, but other embodiments need not include threads. The discharge bore 380 is also in fluid communication with a fluid outlet 450. The centerline 364 of bore 360 is aligned with centerline 384 of bore 380, but, again, these bores need not always be aligned. The bores 320, 340, 360, and 380 of the casing 310 converge to a common intersection, referred to as a cross-bore or cross-bore intersection 400. The cross-bore intersection 400 (i.e., the pumping chamber) defines an open space in housing 310.

As illustrated in FIG. 5, between each pair of intersecting adjacent bores is an intersection corner that has a transition area that includes a surface. Bores 320 and 380 are adjacent to each other and intersect, thereby forming a corner or intersection or overlapping corner 326. Corner 326 includes a transition area 410 between the corners of bores 320 and 380. Similarly, bores 320 and 360 are adjacent to each other and intersect, thereby forming a corner or intersection corner 328. Corner 328 includes a transition area 412 between the corners of bores 320 and 360. Often, surfaces located at the intersection of adjacent bores in a fluid end casing experience a high concentration of stresses due to the internal pressure and the particular fluid being pumped. In this embodiment, intersection corners 326 and 328 with their respective transition areas 410 and 412 are locations at which the concentration of stresses is high during operation of the pump (i.e., the corners bordering plunger bore 320).

Bores 340 and 380 are adjacent to each other and intersect, thereby forming a corner or intersection or overlapping corner 346. Corner 346 includes a transition area 414 between the corners of bores 340 and 380. Similarly, bores 340 and 360 are adjacent to each other and intersect, thereby forming a corner or intersection corner 348. Corner 348 includes a transition area 416 between the corners of bores 340 and 360. Intersection corners 346 and 348 are locations at which the concentration of stresses is high during operation of the pump (i.e., the corners bordering suction bore 340), just like intersection corners 326 and 328.

To reduce the stresses on the surfaces inside of the fluid end casing, and in particular, on the intersection or overlapping corners between adjacent bores, the present invention relates to machined surfaces located in the transition areas between adjacent bores. A portion of each of the surfaces is polished to so that it is aligned with a hemisphere or partial sphere profile. As described herein, the quantity, size and shape of the hemisphere or partial sphere profile surfaces of the transition areas in a particular fluid end casing can vary.

Referring to FIG. 5, an exemplary hemisphere portion or profile 500 is illustrated using shaded lines. The surface of transition area 410 is formed to match the shape of the hemisphere portion 500. Similarly, the surface of transition area 414 is formed to match the shape of the hemisphere portion 500. The hemisphere portion or profile 500 overlaps the corners of adjacent bores 320 and 380 and the corners of adjacent bores 340 and 380. The surfaces of transition areas 410 and 414 form the transition surfaces between bore 380 and the cross-bore 400. The hemisphere portion 500 has a center point 402, which is located at the intersection of the centerlines of adjacent bores. Center point 402 is located at the intersection of centerlines 324 and 384 and the intersection of centerlines 344 and 384.

Similarly, another exemplary hemisphere portion or profile 510 is illustrated using shaded lines. The surface of transition area 412 is formed to match the shape of hemisphere portion 510. Similarly, the surface of transition area 416 is formed to match the shape of hemisphere portion 510. The hemisphere portion or profile 510 overlaps the corners of adjacent bores 320 and 360 and the corners of adjacent bores 340 and 360. The surfaces of transition areas 412 and 416 form the transition surfaces between bore 360 and the cross-bore. The hemisphere portion 510 has a center point, which is located at the intersection of the centerlines of adjacent bores. As shown in FIG. 6, the center point of hemisphere portion 510 is point 402, the same as hemisphere portion 500. Center point 402 is also located at the intersection of centerlines 324 and 364 and the intersection of centerlines 344 and 364.

In this embodiment, the hemisphere portion 500 and transition areas 410 and 414 are located on the top side of the center-bore 400. The hemisphere portion 510 and transition areas 412 and 416 are located on the bottom side of the center-bore 400.

Referring to FIG. 6, additional details of fluid end 300 are illustrated. FIG. 6 is a plan cross-sectional view of the fluid end 300 illustrated in FIG. 4 taken along line "B-B". In this view, bores 360 and 380 are oriented vertically and plunger bore 320 is oriented horizontally. Part of hemisphere portion 500 is illustrated by the shaded lines between bores 360 and 320. The intersection corner 326 is shown between bore 360 and 320. The surface of transition area 410 of intersection corner 326 is shaped along the hemisphere portion 500. In this embodiment, the intersection corner 326 is located on the top side of the cross-bore 400. Similarly, part of hemisphere portion 500 is illustrated by the shaded lines between bores 380 and 320. At the lower side of bore 320, the intersection corner 328 and hemisphere portion 510 are illustrated between bores 320 and 360. The surface of transition area 412 of intersection corner 328 is shaped along the hemisphere portion 510.

Referring to FIG. 7, a bottom cross-sectional view of the fluid end 300 illustrated in FIG. 4 taken along line "C-C" is illustrated. In FIG. 7, bores 320 and 340 are illustrated as being horizontal and aligned with each other, and also intersecting with bore 380. The transition areas 410 and 414 that are formed relative to hemisphere portion 500 on opposite sides of bore 380 are shown. Transition area 410 is located between bores 320 and 380, and transition area 414 is located between bores 340 and 380.

In addition, fluid end 300 includes transition features that are included in transition areas 410 and 414. In particular, transition feature 420 is located in transition area 410 at the intersection of bore 320 and bore 380. Transition feature 420 is configured to reduce the stresses at the intersection of bores 320 and 380. Similarly, transition feature 430 is located at the intersection of bore 340 and bore 380. Transition feature 430 can be referred to as stepped transition feature 430. Stepped transition feature 430 is also configured to reduce the stresses at the intersection of bores 340 and 380.

Figure 8:
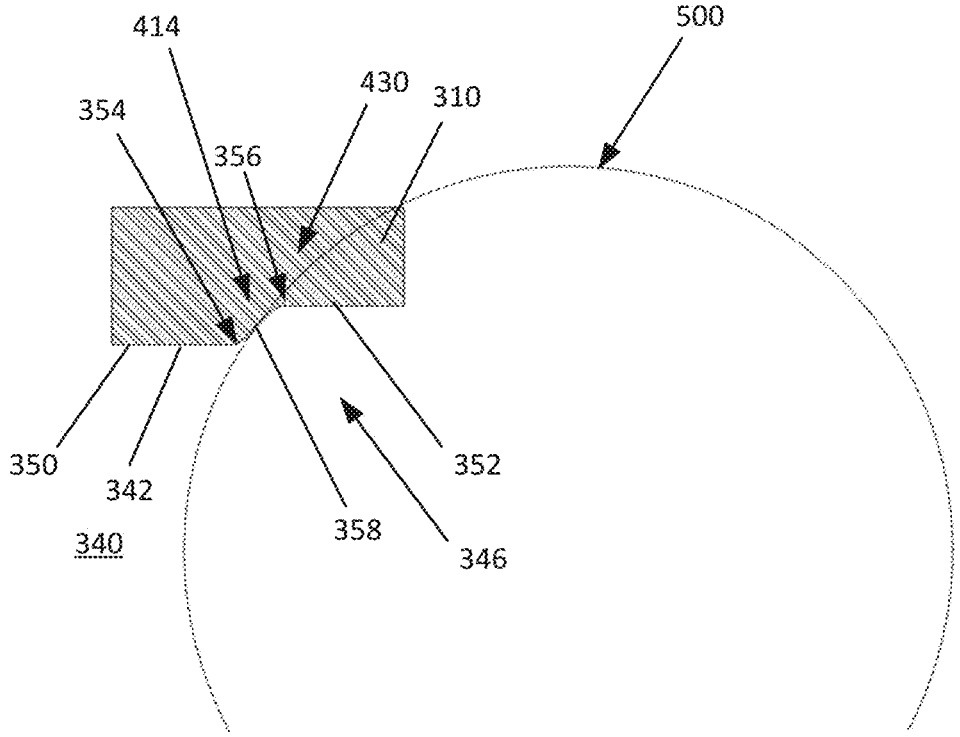
FIG. 8 is a close-up partial side cross-sectional view of a portion of the fluid end illustrated in FIG. 7.

During manufacturing of the fluid end 300, the hemisphere profile of certain surfaces is machined from only one of the two bores that intersect. The other bore has a transition feature, such as transition feature 420 or transition feature 430 shown in FIG. 7. As shown in FIGS. 7 and 8, stepped transition feature 430 is located in bore 340 where there are portions of bore 340 with different inner diameters. In particular, bore 340 has a first bore portion 350 with a first inner diameter and a second bore portion 352 with a second inner diameter different from the first inner diameter. In this embodiment, the second inner diameter is slightly larger than the first inner diameter. The transition feature 430 is located between the first bore portion 350 and the second bore portion 352, and is designed for a smoother transition between bore 340 and bore 380. While the discussion for FIG. 8 relates to transition feature 430, the same discussion applies to transition feature 420 and its relationship between bore 320 and bore 380.

FIG. 8 illustrates a close-up partial side cross-sectional view of the transition feature 430 of transition area 414 in FIG. 7. For ease of discussion, only a small part of fluid end casing 310 is illustrated. For perspective, inner wall 342 defines the inner surface of bore 340. The inner wall 342 has a first bore portion 350 with an inner diameter and a second bore portion 352 with its own inner diameter. In this embodiment, the inner diameter of the first bore portion 350 is smaller than the inner diameter of the second bore portion 352. The first bore portion 350 and the second bore portion 352 of bore 340 have curved, radiused surfaces 354 and 356 therebetween. Radiused surface 354 is located between the inner surface of first bore portion 350 and an angled surface 358. Radiused surface 356 is located between the inner surface of second bore portion 352 and angled surface 358. The angled surface 358 forms a bore cone due to its shape. As shown in FIGS. 7 and 8, the second bore portion 352 is located adjacent to the cross-bore. In addition, the second bore portion 352 and its inner surface are closer to the cross-bore than the first bore portion 350 and its inner surface are to the cross-bore.

Hemisphere profile 500 is shown relative to transition feature 430 of transition area 414, which intersects approximately tangentially to the hemisphere 500, thereby creating a substantially smooth transition at the intersection corner 346 where bore 340 and bore 380 intersect. In this embodiment, as shown in FIGS. 7 and 8, transition feature 430 includes a radiused surface 354 that goes from the smaller inner diameter of first bore portion 350 into angled or conical surface 358 in the bore, and then into another radiused surface 356 that connects to the larger inner diameter of second bore portion 352. The radiused surfaces reduce the concentration of stress on the surfaces in intersection corner 346.

In an alternative embodiment, the bore 340 does not have an angled or conical surface 358. In that configuration, the radiused surfaces 354 and 356 create the full transition from first bore portion 350 to second bore portion 352 without surface 358.

In various embodiments, one or more of the intersection corners 326, 328, 346, and 348, and their respective transition areas 410, 412, 414, and 416, may have a transition feature similar that described above for transition feature 430. For example, each one of the intersection corners 326, 328, 346, and 348 may have a transition feature similar to transition feature 430.

Figure 9:
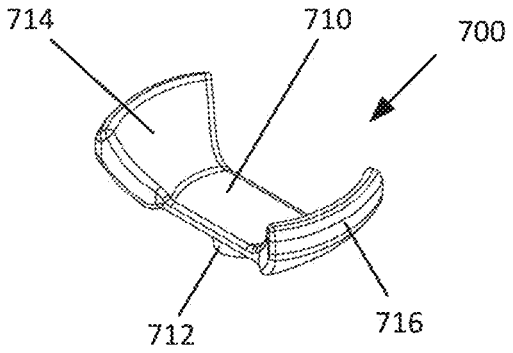
FIG. 9 is a perspective view of an embodiment of a spring retainer according to the present invention.
Figure 11:
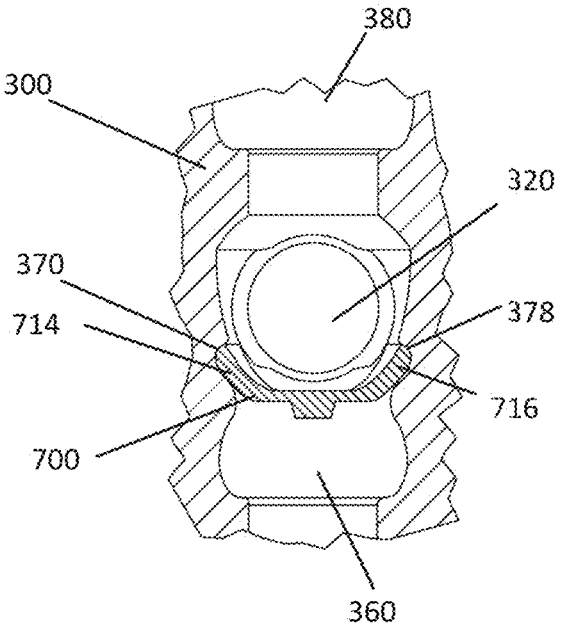
FIG. 11 is a close-up partial plan cross-sectional view of a portion of the fluid end illustrated in FIG. 10 with the spring retainer illustrated in FIG. 9 inserted therein.
Figure 10:
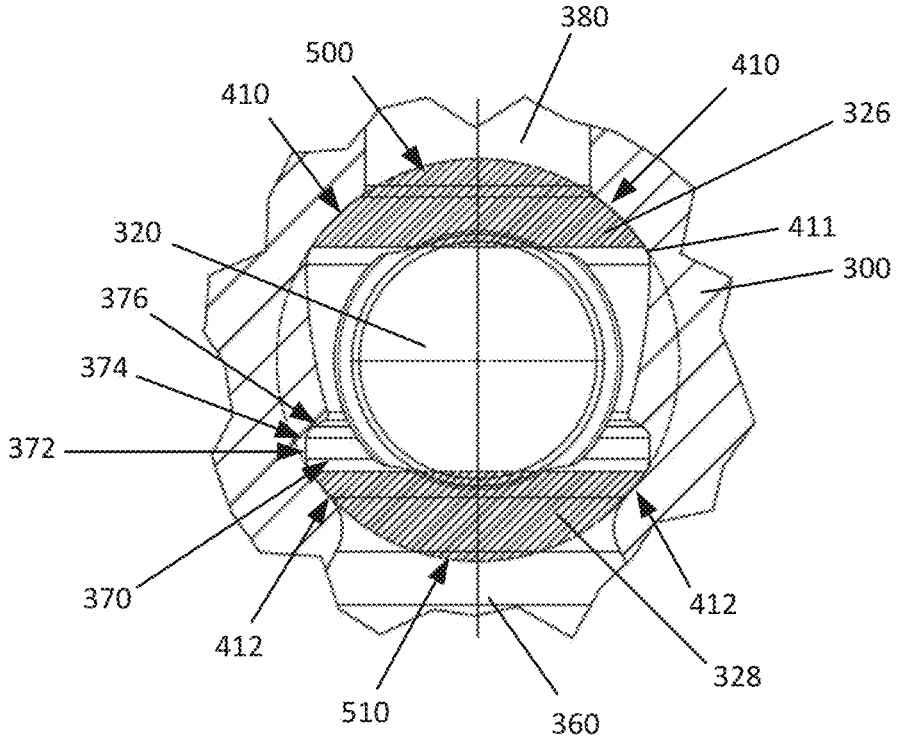
FIG. 10 is a close-up partial plan cross-sectional view of a portion of the fluid end illustrated in FIG. 6 as defined by line "D".

Referring to FIGS. 9-11, details relating to a spring retainer and the grooves formed in the fluid end for the spring retainer are discussed. In FIG. 9, a perspective view of an embodiment of a spring retainer according to the present invention is illustrated. Spring retainer 700 includes a body 710 that has a post 712 formed on its outer surface. The body 710 includes curved ends 714 and 716 opposite to each other relative to the central portion of the body 710. The curved ends 714 and 716 are used to mount the spring retainer 700 within the fluid end housing 310.

Referring to FIG. 10, a close-up partial plan cross-sectional view of a portion of the fluid end illustrated in FIG. 6 as defined by line "D" is illustrated. The housing of the fluid end 300 has bores 320, 360, and 380 formed therein. A recessed area 370 is formed proximate to the inner end of bore 360. The recessed area 370 is machined in the area outside of where the hemispheres or hemisphere profiles overlap the bore intersections. The recessed area 370 includes a flat surface 372, a radiused surface 374, and a flat surface 376. The combination of surfaces 372, 374, and 376 are also present on the opposite side of the bore 360 in FIG. 10 from the labeled surfaces 372, 374, and 376.

In this embodiment, the hemisphere profile 500 on the top of cross-bore 400 between bores 320 and 380 is illustrated. Transition area 410 of intersection corner 326 between bore 320 and bore 380 is shown along the hemisphere profile 500 between bores 320 and 380. Similarly, the hemisphere profile 510 on the bottom of cross-bore 400 between bores 320 and 360 is illustrated. Transition area 412 of intersection corner 328 between bore 320 and bore 360 is shown along the hemisphere profile 510 between bores 320 and 360. The transition area 412 transitions into a straight, cylindrical surface 372, which in turn transitions to a radiused surface 374. The transition area 410 transitions into an angled face or bore cone 411.

FIG. 11 is a close-up partial plan cross-sectional view of a portion of the fluid end illustrated in FIG. 10 with the spring retainer illustrated in FIG. 9 inserted therein. As shown, the fluid end 300 includes a spring retainer 700 mounted proximate to bore 360. Bores 320 and 360 are illustrated to provide perspective. When the spring retainer 700 is inserted, end 714 is engaged with recess area 370 and end 716 is engaged with spring retainer groove or recess area 378.

Figure 12:
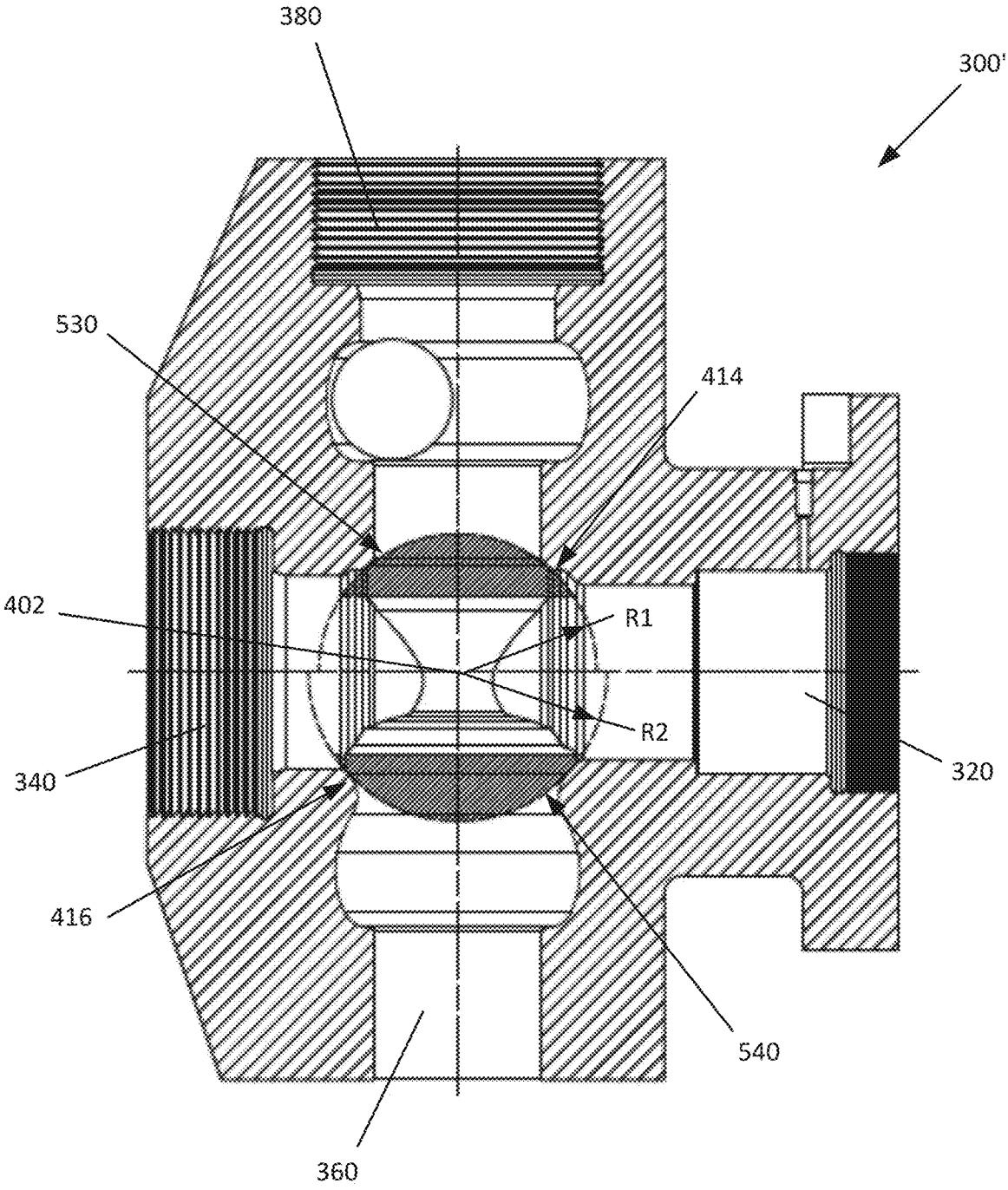
FIG. 12 is a side cross-sectional view of another embodiment of a fluid end according to the present invention.
Figure 13:
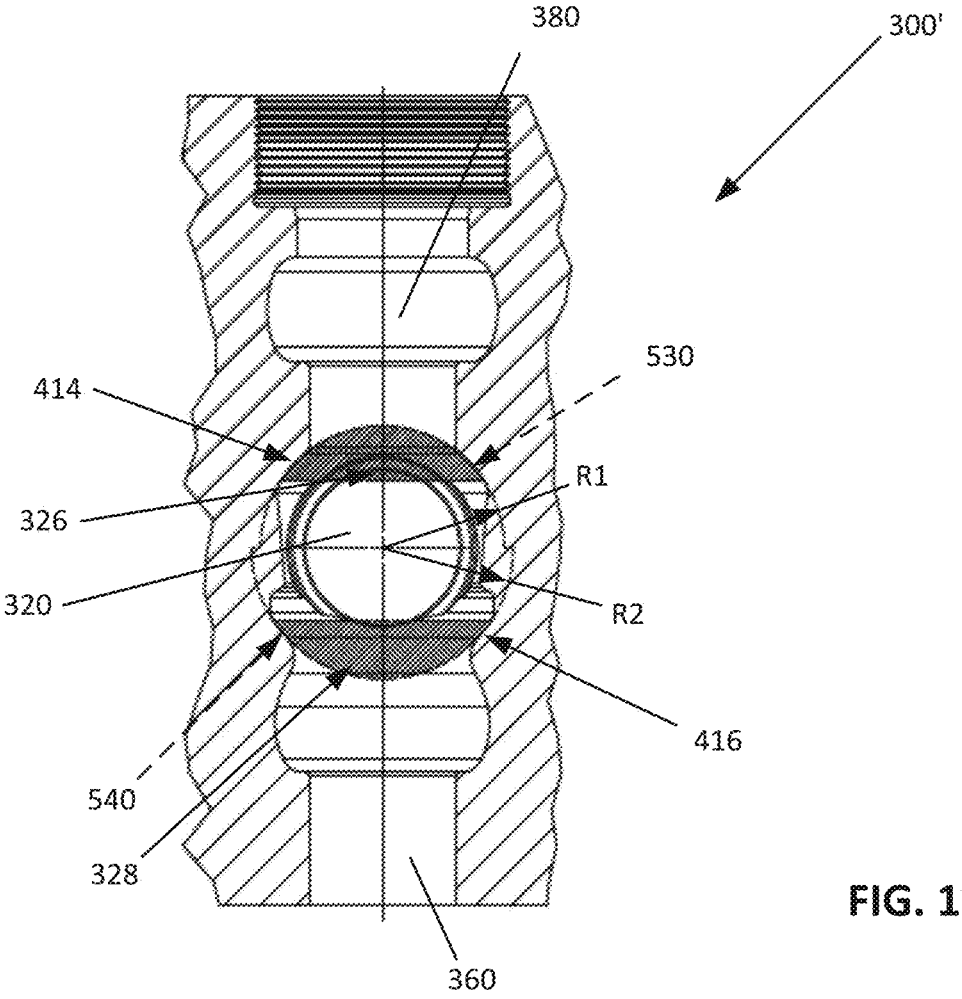
FIG. 13 is a plan cross-sectional view of the fluid end illustrated in FIG. 12.
Figure 14:
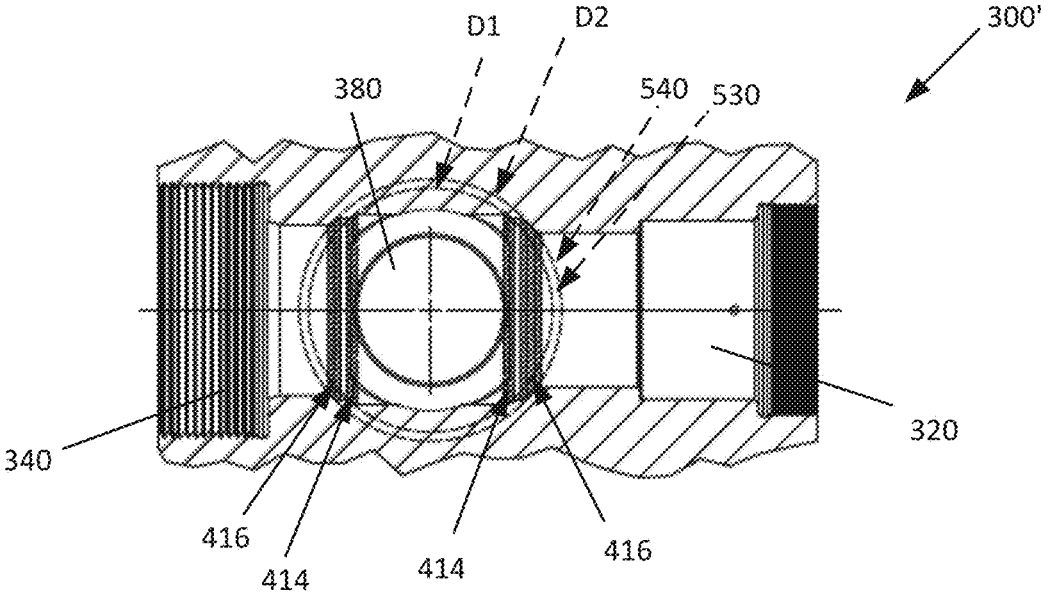
FIG. 14 is a bottom cross-sectional view of the fluid end illustrated in FIG. 12.

Referring to FIGS. 12-14, an alternative embodiment of a fluid end 300' according to the present invention is illustrated. As shown, fluid end 300' includes bores 320, 340, 360, and 380 similar to the previously described fluid end 300. Fluid end 300' includes two hemisphere portions 530 and 540 that include or define transition surfaces 414 and 416, respectively.

Different intersecting bores can have hemispheres of different radii. In this embodiment, hemisphere portion 530 has a radius that is different than the radius of hemisphere portion 540, with both radii starting at the center point 402. The radius of hemisphere portion 530, shown as arrow R1, is smaller than the radius of hemisphere portion 540, shown as arrow R2. As a result, the radius at which transition surface 414 is formed is different than the radius at which transition surface 416 is formed. In different embodiments, radius R2 can be smaller than radius R1.

In some instances, there is a benefit of using radii of differing sizes in the cross-bore to form the intersection corners and their transition areas. One is example is in a pump fluid end in which there is a tight space requiring a comparatively low discharge valve chamber as compared to the cross-bore location. In that scenario, using a hemisphere portion on the top of the cross-bore that has the same radius as the hemisphere portion on the bottom of the cross-bore could result in the valve seat on the top of the cross-bore poking through into the cross-bore chamber, which could negatively impact the sealing surface of the valve seat in its bore. By using a smaller radius for the hemisphere portion on the top side of the cross-bore, more material remains around the bottom of the valve seat along the discharge valve port, thereby improving the sealing of the valve seat as well as avoiding the valve seat from poking through into the cross-bore. Thus, the discharge valve seat engagement in its bore is maximized without reducing the radius in the lower half of the cross-bore. Reducing the radius in the lower half of the cross-bore would increase the stress at the intersections of adjacent bores, particularly when the lower half of the cross-bore has a higher stress than the top half of the cross-bore. Thus, the lower half of the cross-bore is the limiting factor of the design.

Returning back to FIG. 12, less material is removed from the intersections of bores 320, 340, and 380 with the cross-bore on the top half of the cross-bore, as compared to the amount of material removed from the intersections of the bores 320, 340, and 360 and the cross-bore on the bottom half of the cross-bore. Thus, the radius R1 is smaller than radius R2.

Turning to FIGS. 13 and 14, the different radii of transition areas or surfaces 414 and 416 are illustrated in the different cross-sectional views. As described above, transition area 414 is formed on intersection corner 326, and transition area 416 is formed on intersection corner 328. In FIG. 13, hemisphere portion 530 with transition surface 414 having radius R1 and hemisphere portion 540 with transition surface 416 having radius R2 are shown. Referring to FIG. 14, transition surface 414 is illustrated on surfaces on opposite sides of bore 380. Similarly, transition surface 416 is illustrated on surfaces on opposite sides of bore 380. In this view, the profile of transition surface 414 is reflected by the dashed circle having a diameter D1. Similarly, the profile of transition surface 416 is reflected by the dashed circle having a diameter D2. Diameter D2 is larger than diameter D1.

Figure 15:
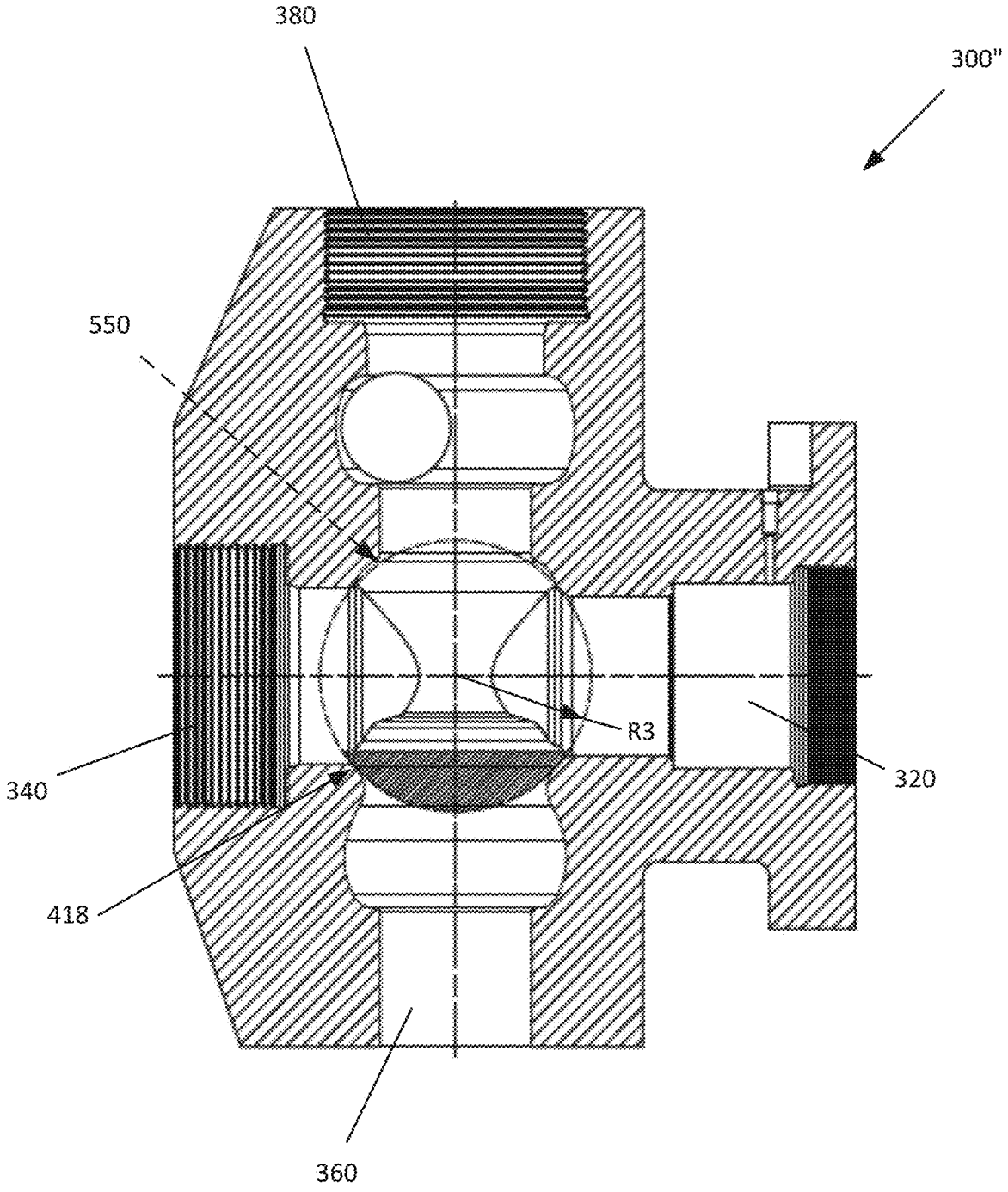
FIG. 15 is a side cross-sectional view of another embodiment of a fluid end according to the present invention.
Figure 16:
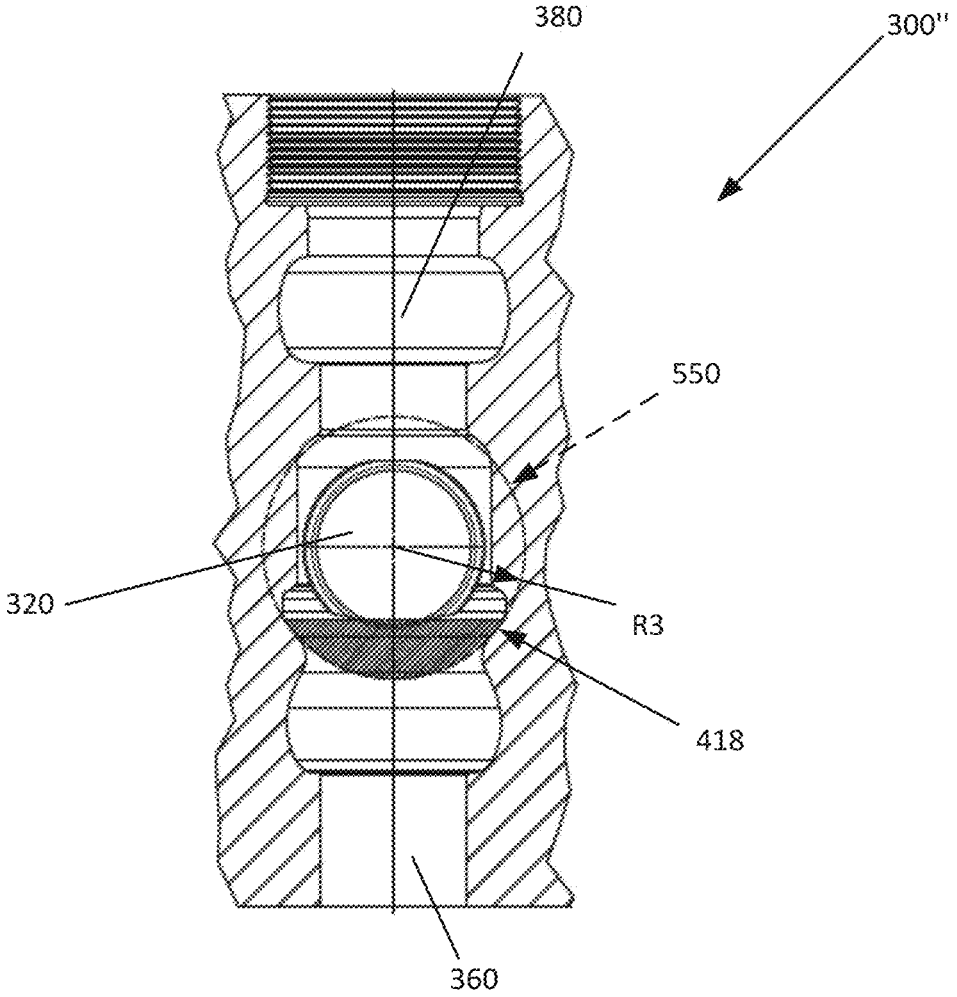
FIG. 16 is a plan cross-sectional view of the fluid end illustrated in FIG. 15.

Referring to FIGS. 15 and 16, another embodiment of a pump fluid end according to the present invention is illustrated. Referring to FIG. 15, a cross-sectional view of fluid end 300" is shown. Fluid end 300" includes bores 320, 340, 360, and 380 similar to fluid ends 300 and 300' described above. In this embodiment, even though more than two bores intersect, all of the intersecting bores do not have the partial sphere or hemisphere geometry. In this embodiment, a transition surface 418 having a hemisphere or partial sphere profile is formed between each of bores 320, 340, and 360 and the cross-bore, which collectively relate to the bottom side of cross-bore. A transition area 418 with a surface is formed as part of hemisphere portion or profile 550, which has a radius represented by arrow R3. When only two of the intersection corners, or in other words, one side of the cross-bore, have a hemisphere profile for the surfaces of their transition corners, the concentration of stress on those intersection corners is reduced, and the stress on the intersection corners on the other side of the cross-bore is not reduced.

Turning to FIG. 16, the transition area 418 and its surface between bores 320 and 360 is illustrated. Notably, there is no machine finishing to a hemisphere geometry of the intersection corner between bores 320 and 380. Bore intersections that do not have the hemisphere geometry will likely still require hand finishing to create the transition radii into the cross-bore.

Figure 17:
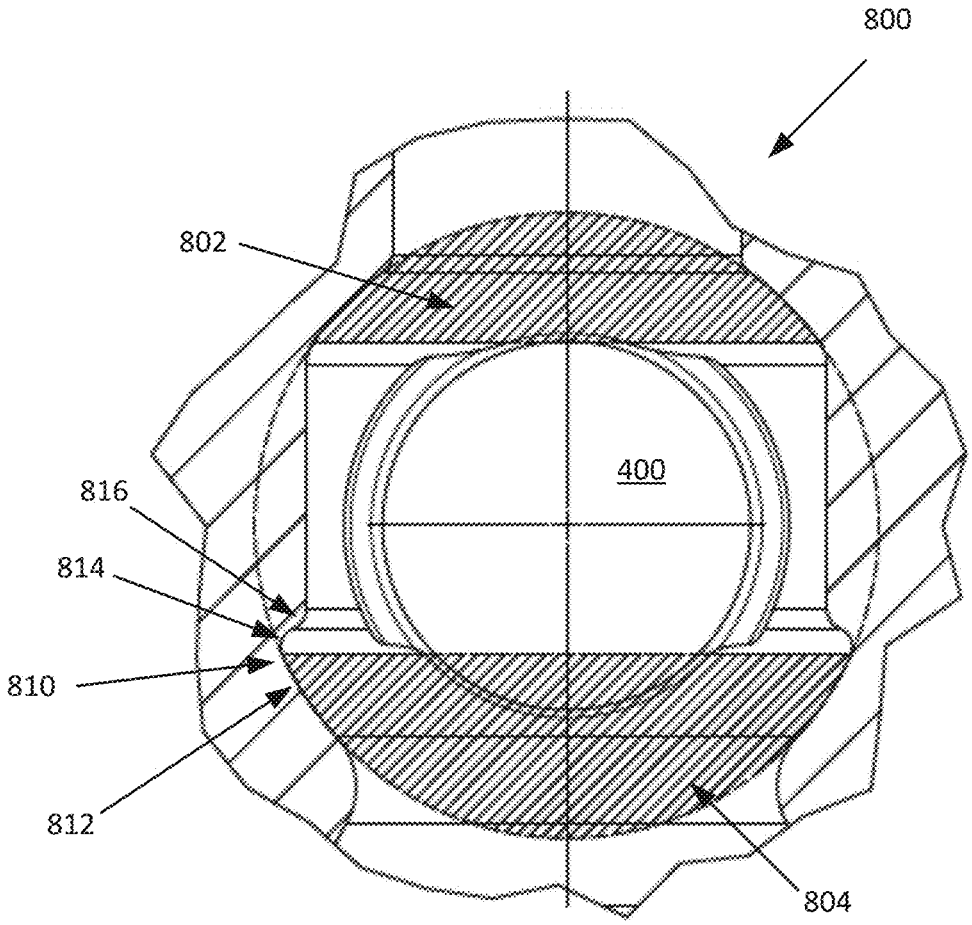
FIG. 17 is a close-up partial plan cross-sectional view of a portion of the fluid end illustrated in FIG. 15.

FIG. 17 illustrates part of an alternative embodiment of a fluid end according to the present invention. In this embodiment, fluid end 800 has a first partial sphere or hemisphere transition profile 802 on the top of the cross-bore 400 and a second partial sphere or hemisphere transition profile 804 on the bottom of the cross-bore 400. A spring retainer groove or recessed area 810 is formed above the intersection of the bores. Spring retainer groove includes several curved or radiused surfaces 812, 814, and 816. In this embodiment, no flat surfaces or features are included for spring retainer groove 810.

Figure 18:
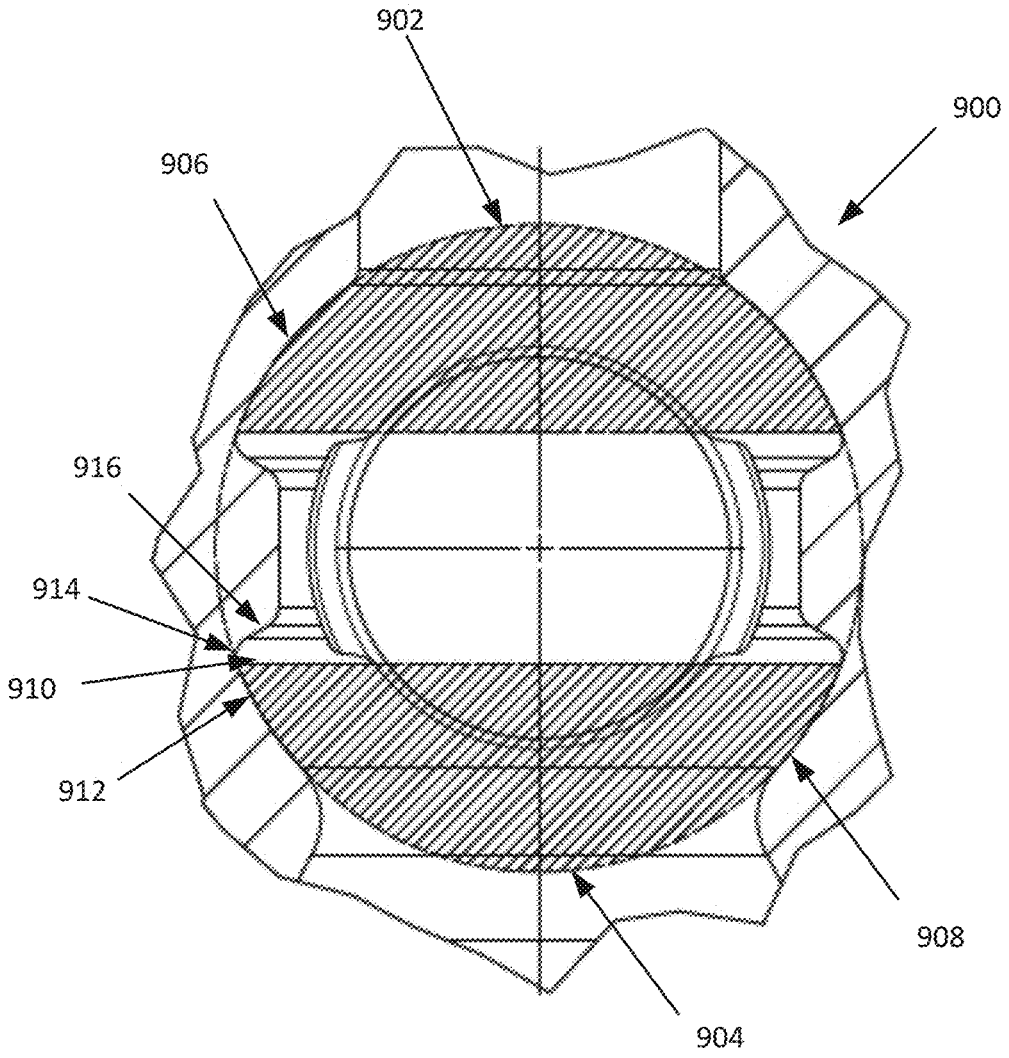
FIG. 18 is a close-up partial plan cross-sectional view of a portion of another embodiment of a fluid end according to the present invention.
Figure 19:
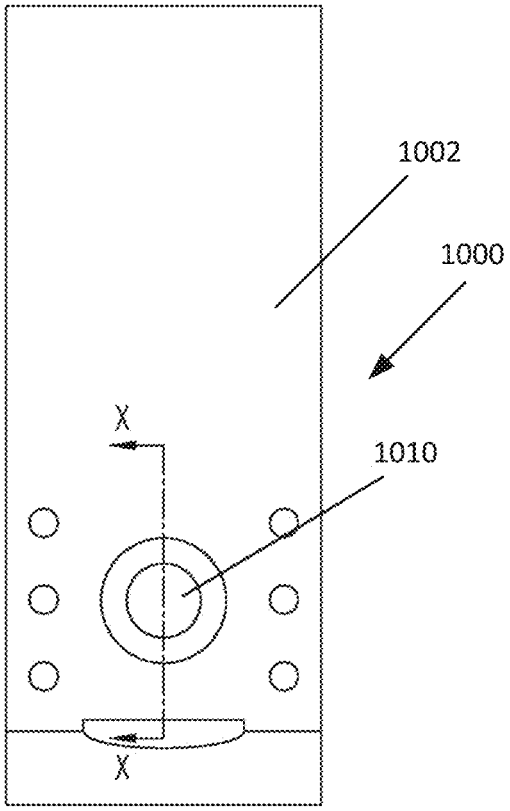
FIG. 19 is a plan view of an embodiment of a drilling module according to the present invention.
Figure 20:
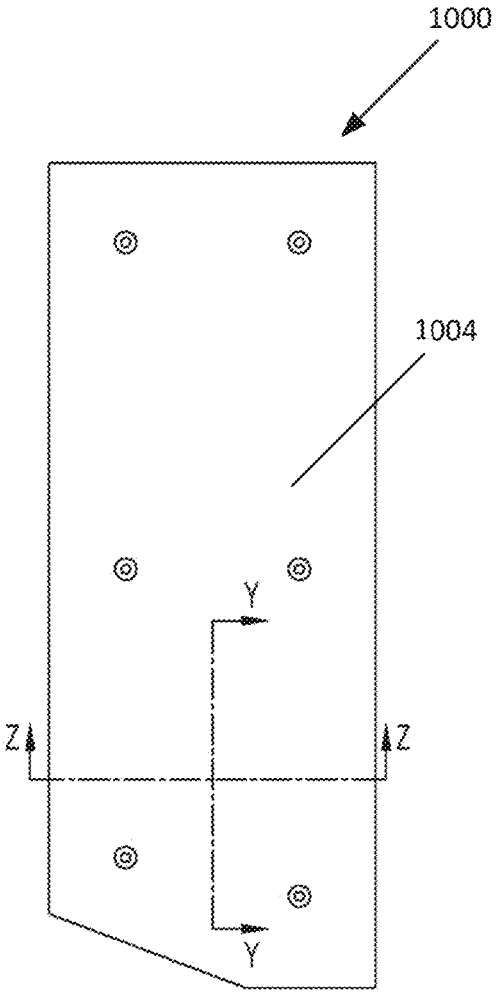
FIG. 20 is a side view of the drilling module illustrated in FIG. 19.

FIG. 18 illustrates part of an alternative embodiment of a fluid end according to the present invention. In this embodiment, fluid end 900 has a first partial sphere or hemisphere portion 902 on the top of the cross-bore and a second partial sphere or hemisphere portion 904 on the bottom of the cross-bore. In this embodiment, transition surfaces 906 and 908 that are defined in part by the hemisphere portions 902 and 904, respectively, are symmetrical about the centerline of cross-bore. A spring retainer groove or recessed area 910 is formed above the intersection of the bores. Spring retainer groove 910 includes two curved or radiused surfaces 912 and 914, and flat surface 916 that is connected to curved surface 914.

Figure 21:
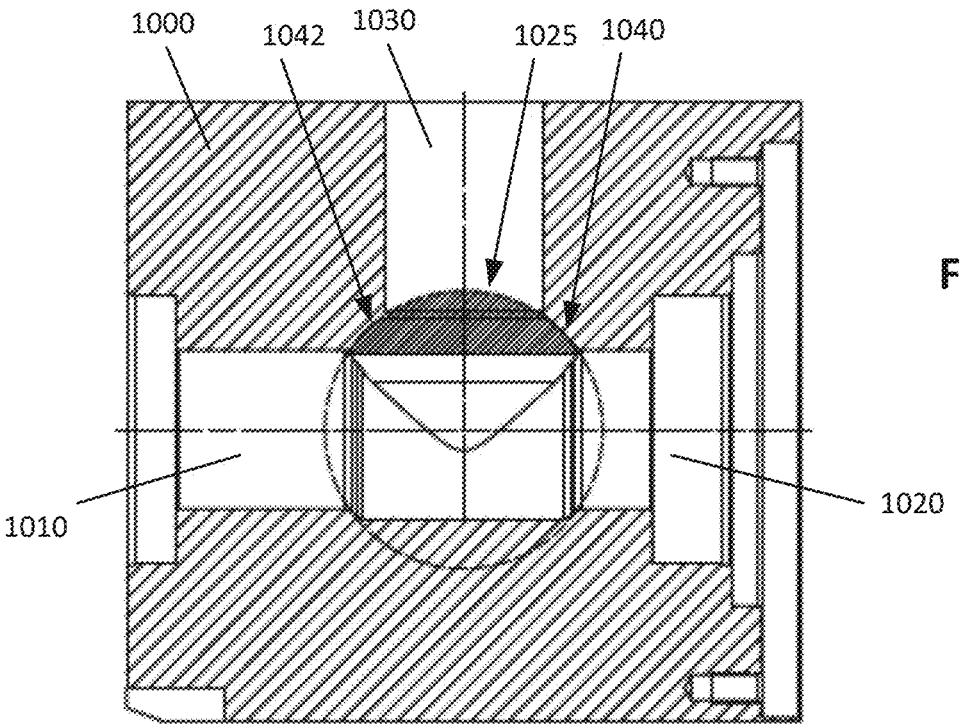
FIG. 21 is a side cross-sectional view of the drilling module illustrated in FIG. 19 taken along line "X-X".
Figure 22:
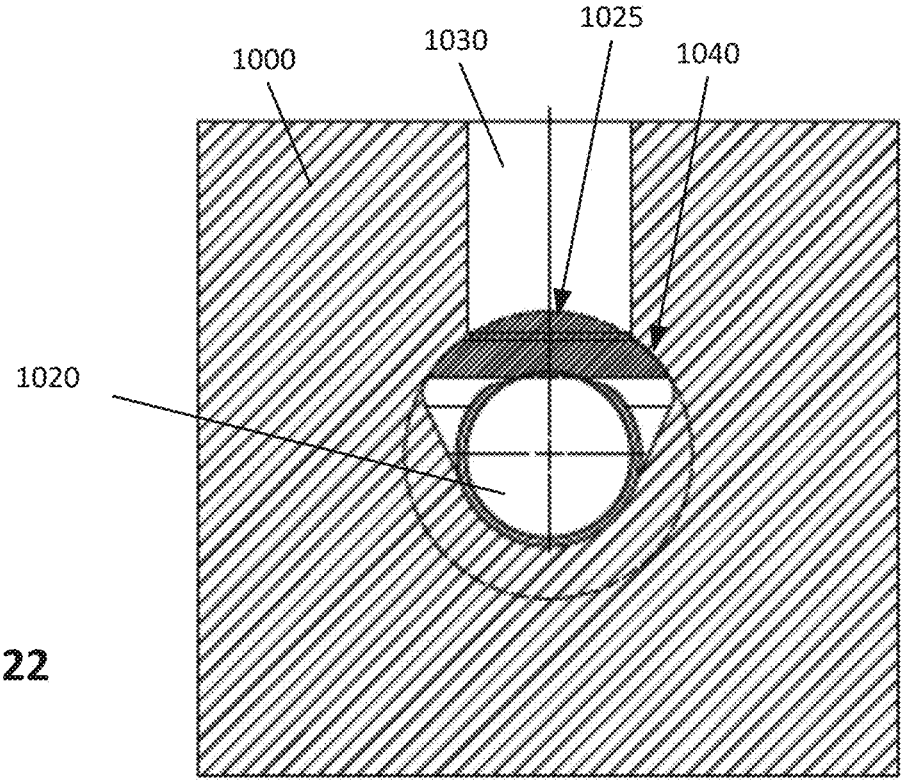
FIG. 22 is a plan cross-sectional view of the drilling module illustrated in FIG. 20 taken along line "Y-Y".
Figure 23:
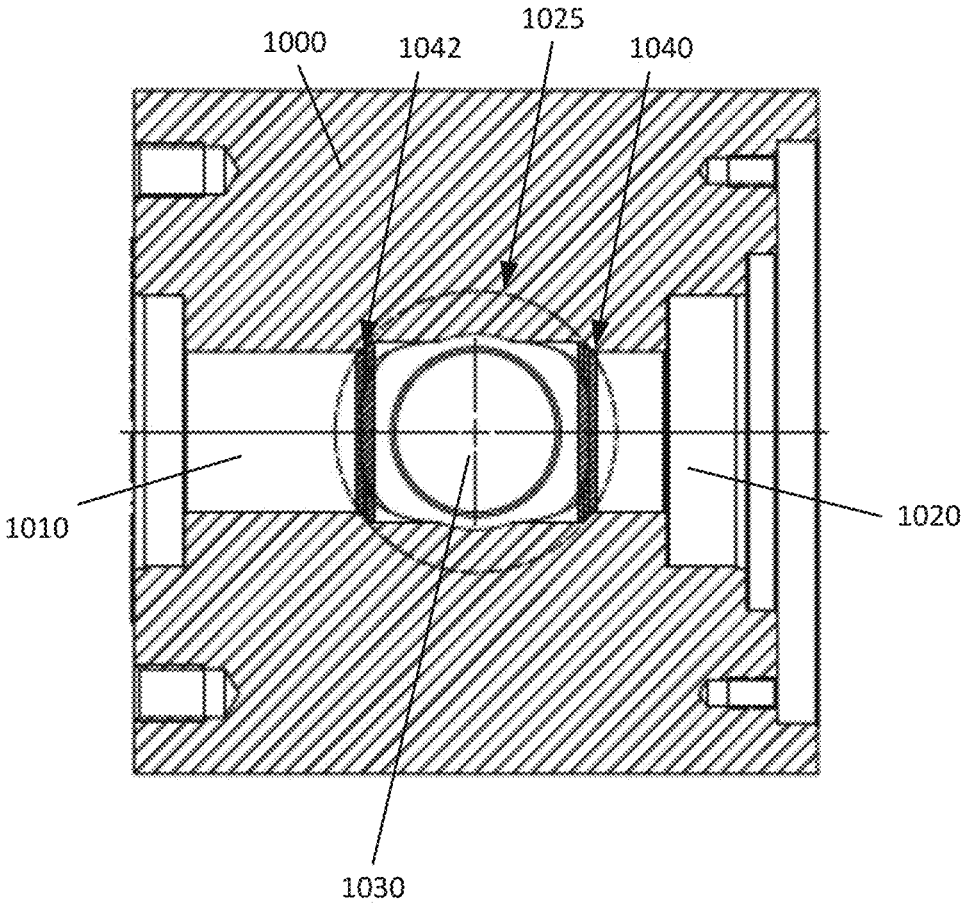
FIG. 23 is a bottom cross-sectional view of the drilling module illustrated in FIG. 20 taken along line "Z-Z".

Referring to FIGS. 19-23, the concept of a partial sphere or hemisphere portion or profile relative to another cross-bore is shown with respect to a drilling module. Drilling module 1000 has a front surface 1002 with a bore 1010 formed therein, and opposite side surfaces 1004. A side cross-sectional view along line "X-X" is illustrated in FIG. 21, a front cross-sectional view along line "Y-Y" is illustrated in FIG. 22, and a bottom cross-sectional view along line "Z-Z" is illustrated in FIG. 23.

As shown in FIG. 21, the centerline of bore 1010 is aligned with the centerline of bore 1020. A third bore 1030 is perpendicular to bores 1010 and 1020. A partial sphere or hemisphere portion or profile 1025 is illustrated in the shaded lines. An intersection corner 1040 is at the intersection of bores 1020 and 1030 and an intersection corner 1042 is at the intersection of bores 1010 and 1030. Each of the intersection corners 1040 and 1042 includes a transition surface that is machined along the hemisphere profile 1025. In this embodiment, one of the intersecting bores includes the hemisphere, while the other two intersecting bores includes the stepped transition feature described above. For example, in one implementation, bore 1030 includes the hemisphere portion or profile and each of the bores 1010 and 1020 includes a transition surface that is machined along the hemisphere profile 1025.

Referring to FIG. 23, a top cross-sectional view is illustrated. As shown, the surfaces of transition areas and surfaces of intersection corners 1040 and 1042 are located between bores 1020 and 1030 and between bores 1010 and 1030, respectively.

Figure 24:
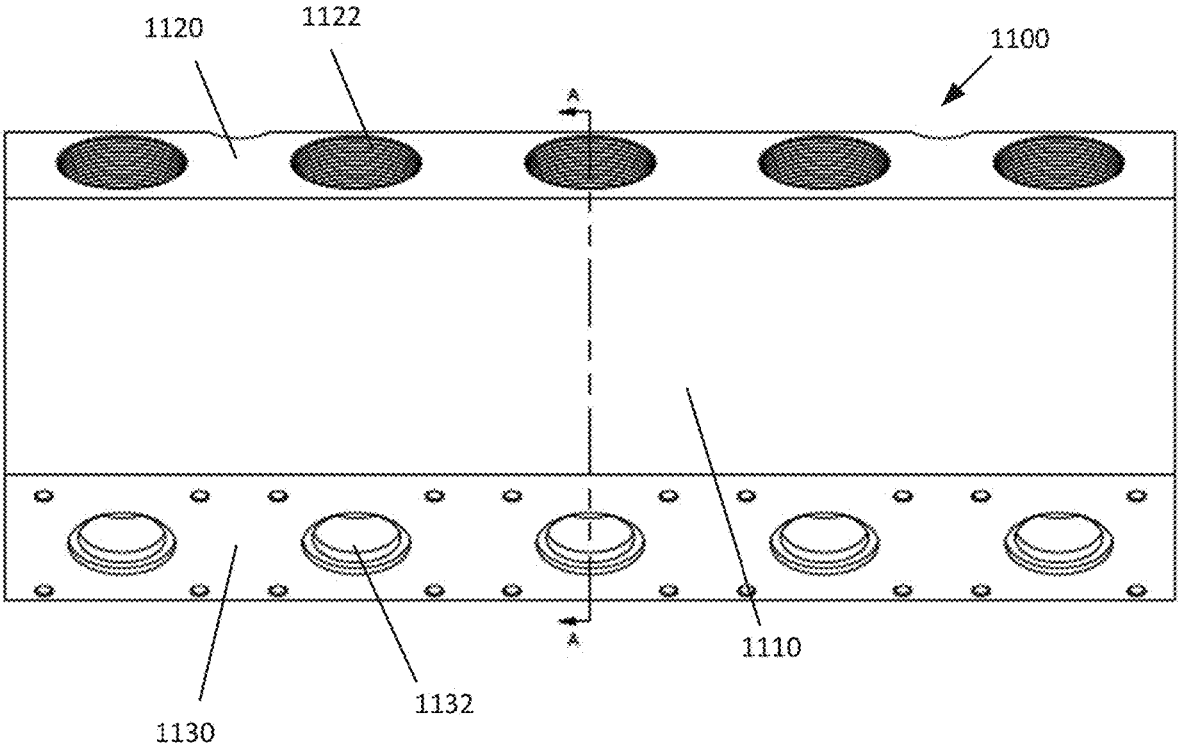
FIG. 24 is a plan view of another embodiment of a fluid end according to the present invention.
Figure 25:
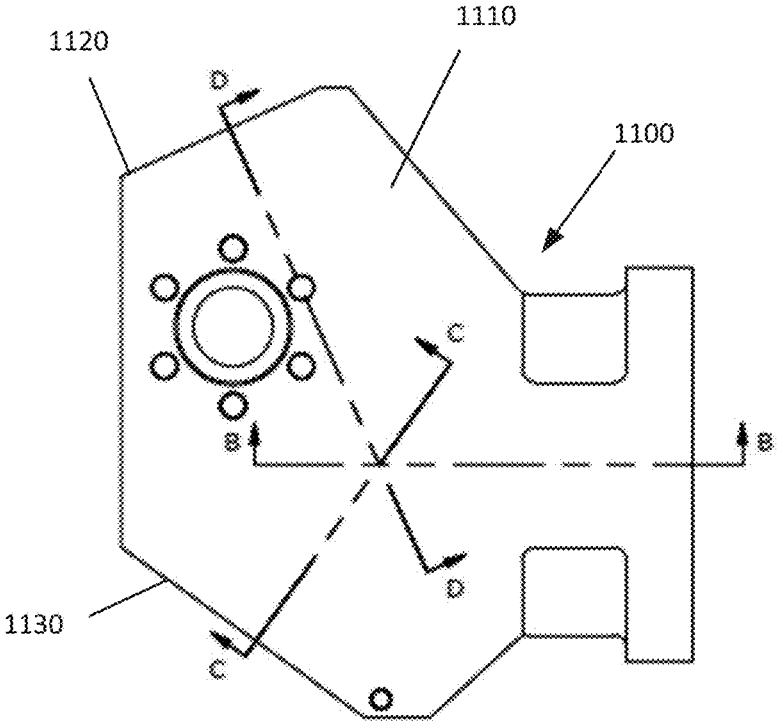
FIG. 25 is a side view of the fluid end illustrated in FIG. 24.

Referring to FIGS. 24-30, another embodiment of a fluid end according to the present invention is illustrated. Fluid end 1100 is a Y-style fracking pump fluid end. In this embodiment, the fluid end 1100 includes a housing 1110 with several bores formed therein. In FIGS. 24 and 25, the housing 1110 includes outer surfaces 1120 and 1130 that have several bores 1122 and 1132, respectively, formed therein.

Figure 26:
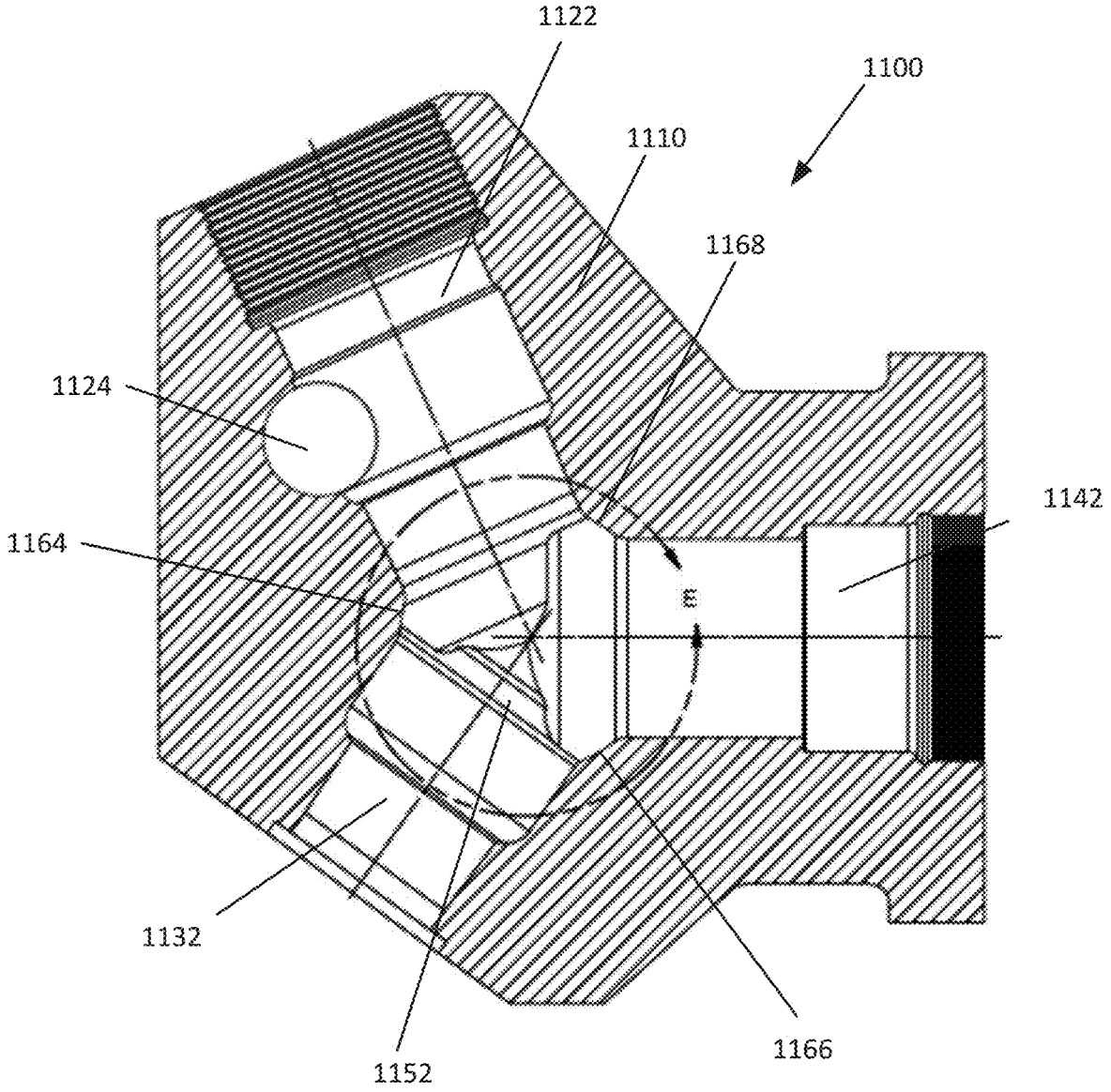
FIG. 26 is a side cross-sectional view of the fluid end illustrated in FIG. 24 taken along line "A-A".

Referring to FIG. 26, a side cross-sectional view of fluid end 1100 taken along line "A-A" in FIG. 24 is illustrated. The fluid end housing 1110 has three sets of intersecting bores 1122, 1132, and 1142 formed therein. In this embodiment, bores 1122, 1132, and 1142 are neither parallel nor perpendicular to each other. The bores 1122, 1132, and 1142 are in fluid communication with an intersection bore 1152. In addition, an outlet 1124 is in fluid communication with bore 1122.

One of the bores 1122, 1132, and 1142 includes a stepped transition feature that blends into the other two bores which use the hemisphere geometry. In this embodiment, one of the hemisphere geometries is slightly smaller than the other hemisphere geometry. The smaller hemisphere geometry doubles as a transition feature, which allows the larger hemisphere to intersect the smaller radius that blends the smaller hemisphere with its bore.

The surface at the intersection of bores 1122 and 1132 is formed as hemisphere transition surface 1164. Similarly, the surface at the intersection of bores 1132 and 1142 is formed as hemisphere transition surface 1166. Also, the surface at the intersection of bores 1142 and 1122 is formed as hemisphere transition surface 1168.

Figure 27:
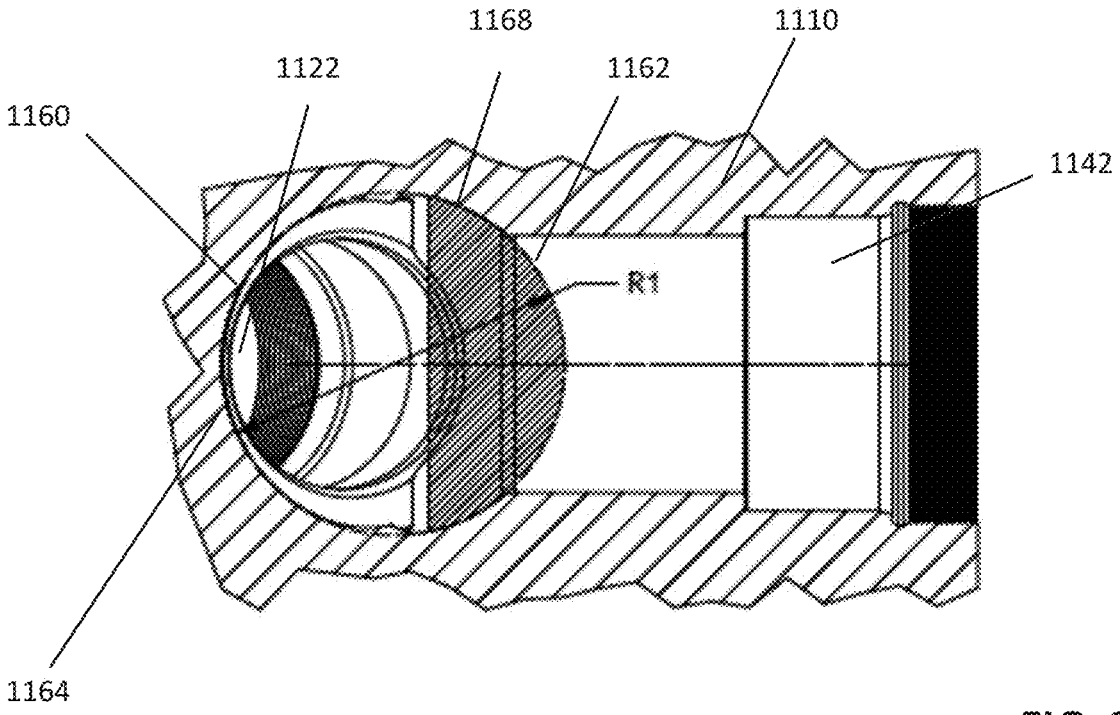
FIG. 27 is a bottom cross-sectional view of the fluid end illustrated in FIG. 25 taken along line "B-B".

Referring to FIG. 27, a bottom cross-sectional view of fluid end 1100 taken along line "B-B" in FIG. 25 is illustrated. The hemisphere transition surface 1168 is shown at the intersection of bores 1122 and 1142. This surface 1168 is defined by hemisphere portion or profile 1160 and by hemisphere portion or profile 1162, each of which is illustrated by the shaded lines. In this embodiment, the hemisphere portion or profile 1162 has a diameter R1 as shown in FIG. 27.

Figure 28:
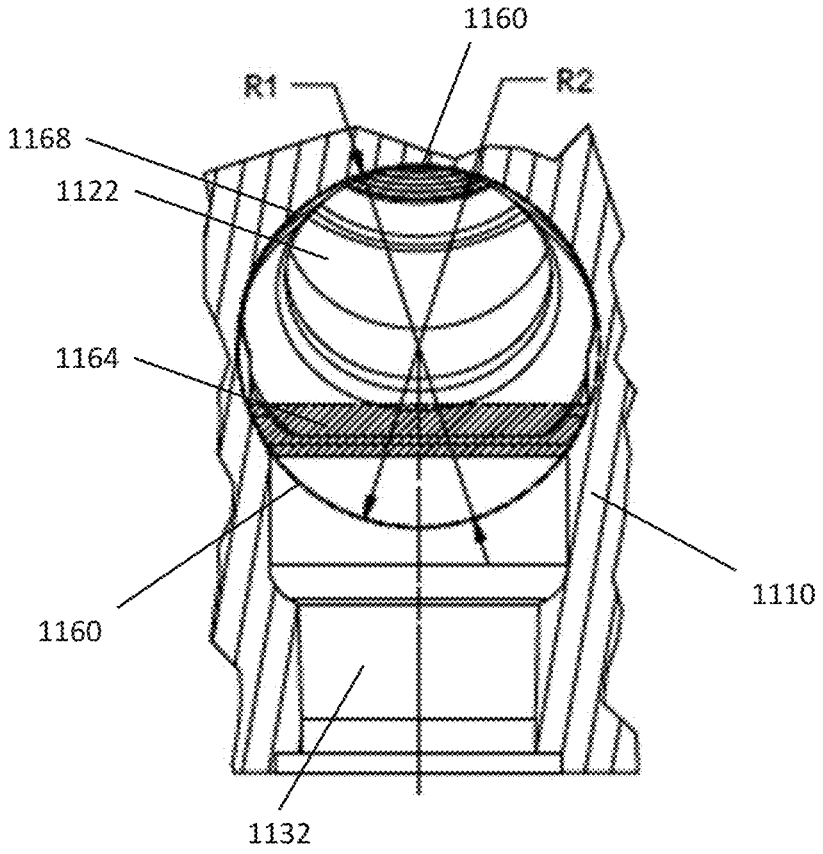
FIG. 28 is a partial cross-sectional view of the fluid end illustrated in FIG. 25 taken along line "C-C".

Referring to FIG. 28, a partial cross-sectional view of the fluid end 1100 taken along line "C-C" in FIG. 25 is illustrated. The intersection between bore 1122 and bore 1132 is shown as hemisphere transition surface 1164, which matches the hemisphere portion or profile 1160. Also visible in FIG. 28 is a portion of hemisphere transition surface 1168, which also matches the hemisphere portion or profile 1160 as well as hemisphere portion or profile 1162.

Figure 29:
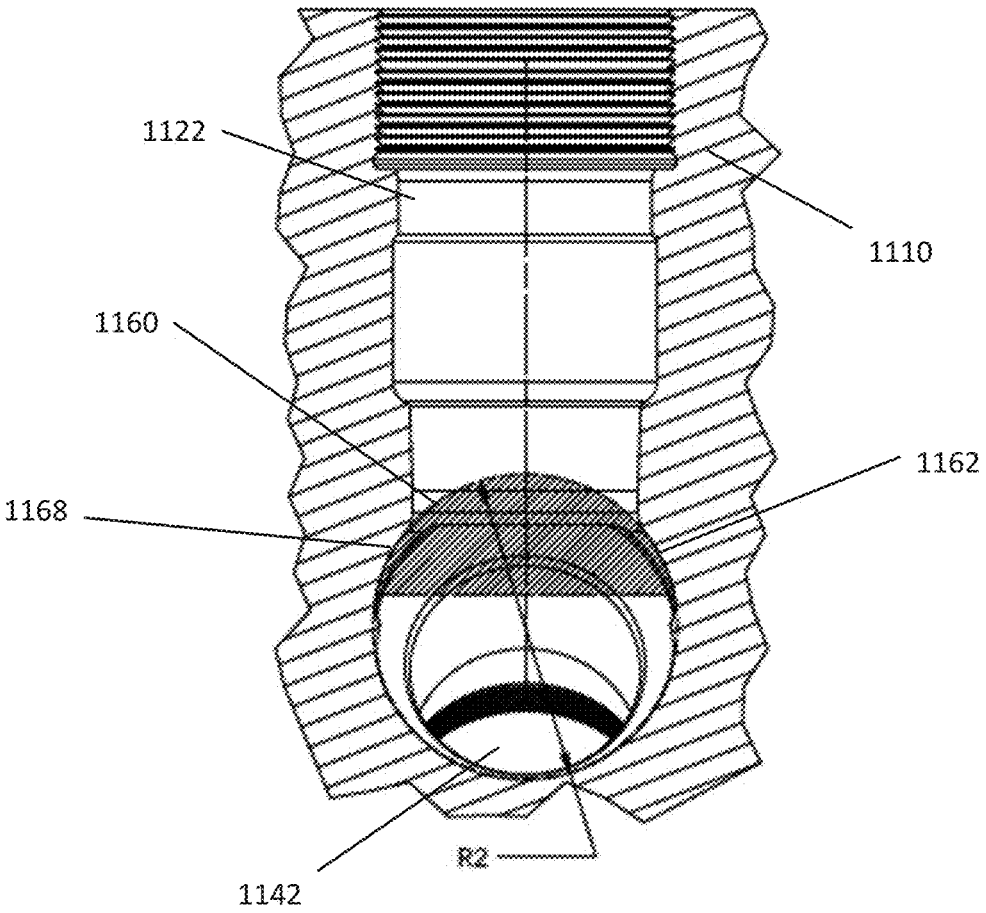
FIG. 29 is a partial cross-sectional view of the fluid end illustrated in FIG. 25 taken along line "D-D".

Referring to FIG. 29, a partial cross-sectional view of the fluid end taken along line "D-D" in FIG. 25 is illustrated. The intersection between bore 1122 and bore 1142 is shown as hemisphere transition surface 1168, which matches hemisphere profile 1160, which has a diameter R2.

Figure 30:
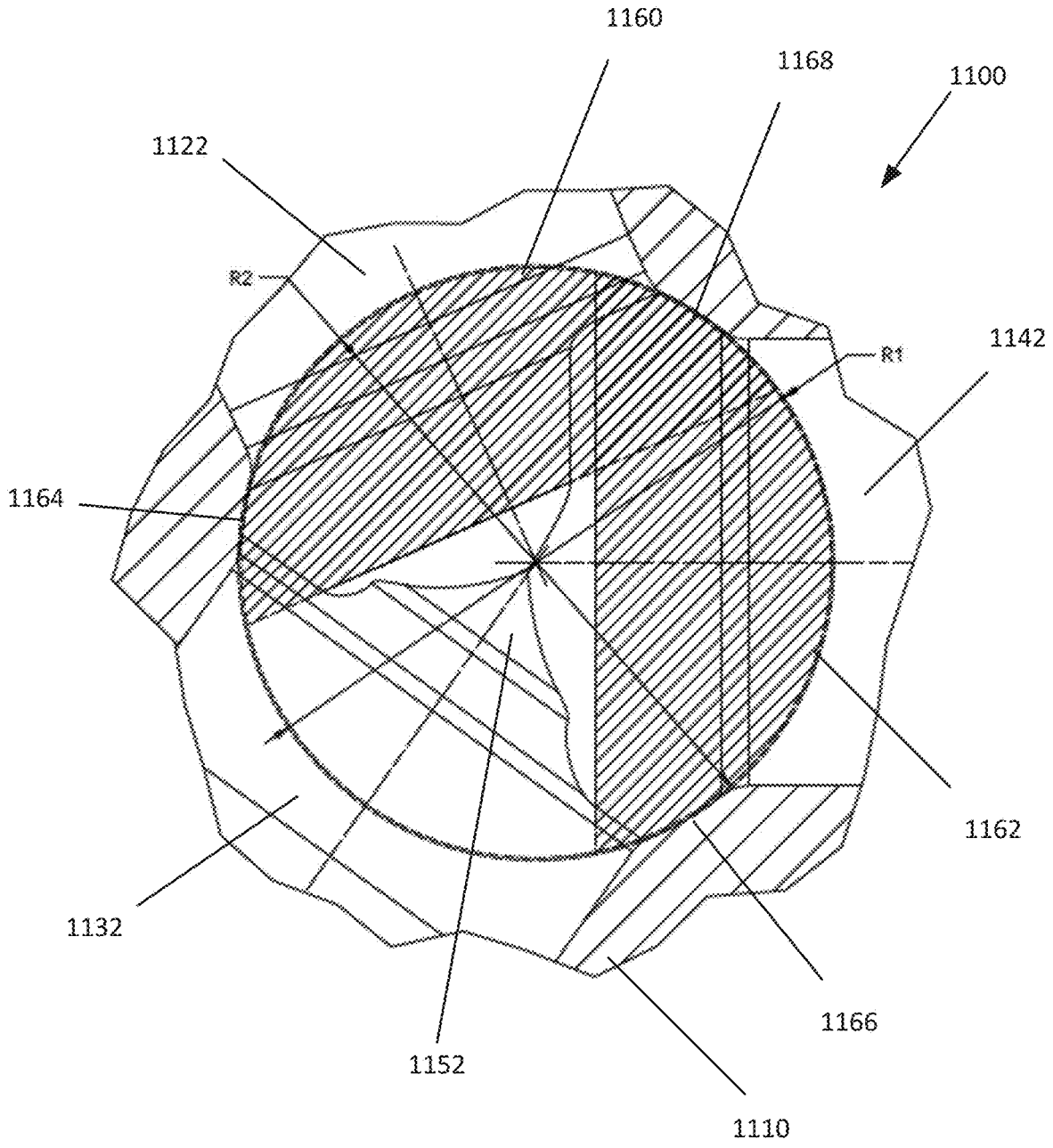
FIG. 30 is a close-up cross-sectional view of the fluid end illustrated in FIG. 26 as defined by line "E".

FIG. 30 is a close-up cross-sectional view of the fluid end illustrated in FIG. 26 as defined by line "E". The intersections of the bores 1122, 1132, and 1142 of fluid end 1100 are hemisphere transition surfaces 1164, 1166, and 1168. In this embodiment, hemisphere transition surfaces 1164 and 1168 match or are aligned with hemisphere profile 1160, which as a diameter R2. In addition, hemisphere transition surfaces 1168 and 1166 match or are aligned with hemisphere profile 1162, which has a diameter R1. In this embodiment, the diameter R1 of hemisphere profile 1162 is slightly different than the diameter R2 of hemisphere profile 1160. In one embodiment, hemisphere portion 1160 has a diameter R2 of 7" and hemisphere portion 1162 has a diameter R1 of 6.94. As mentioned above, the smaller hemisphere functions as a transition feature so that the larger hemisphere can intersect the smaller radius that blends the smaller hemisphere.

Referring to FIGS. 31-35, an embodiment of a block according to the present invention is illustrated. Block can be plumbed into the discharge line of a drilling iron. As shown, the block only has two bores that intersect, with one of the bores using a hemisphere profile for its intersecting surface and the other bore using a transition feature.

Figure 31:
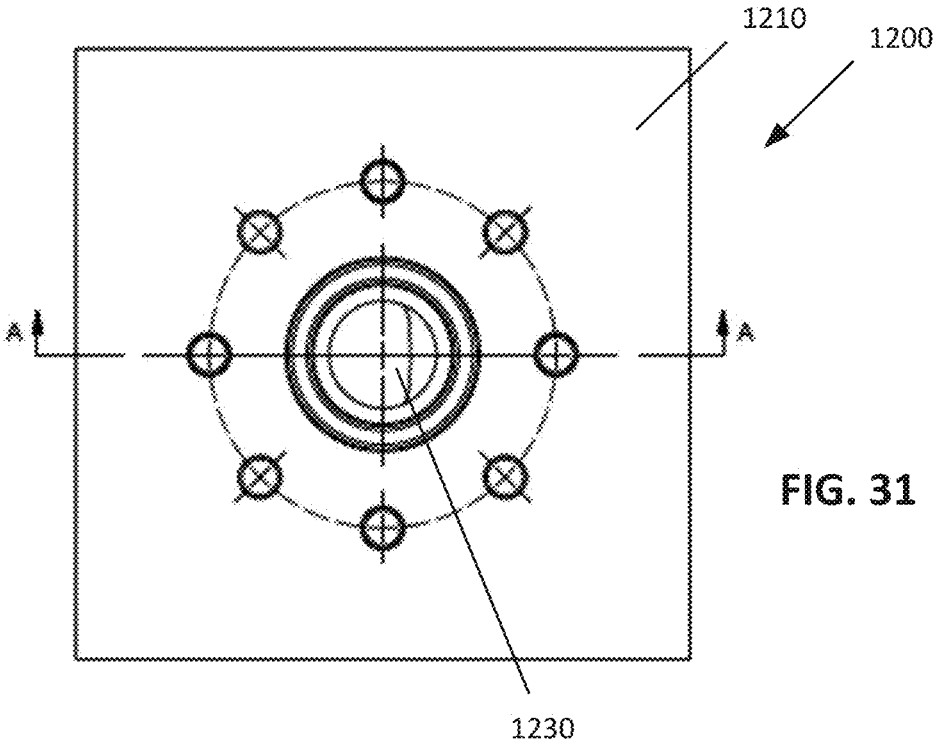
FIG. 31 is a top view of an embodiment of a block according to the present invention.
Figure 32:
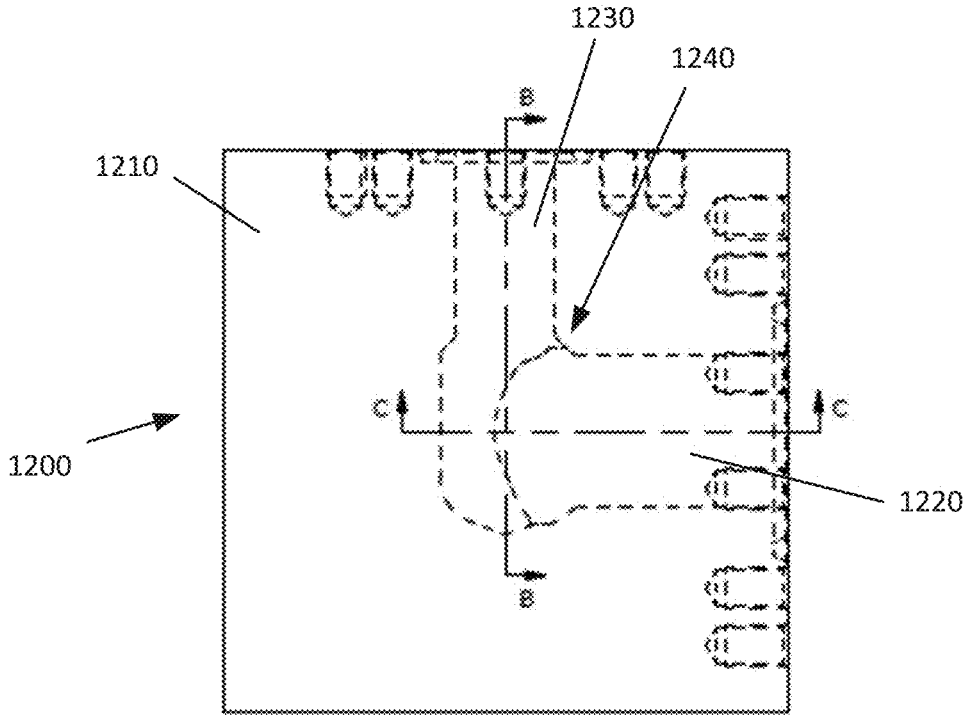
FIG. 32 is a side view of the block illustrated in FIG. 31.
Figure 33:
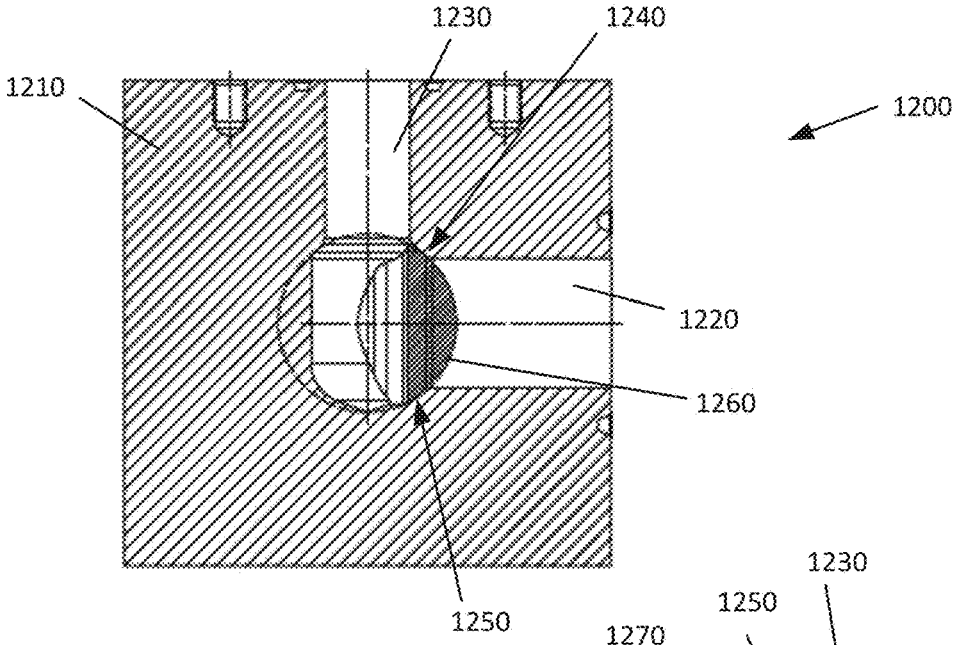
FIG. 33 is a side cross-sectional view of the block illustrated in FIG. 31 taken along line "A-A".
Figure 34:
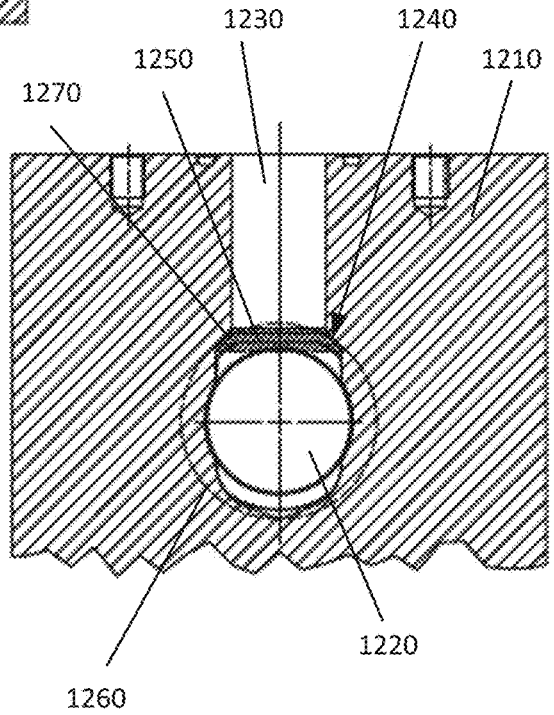
FIG. 34 is a rear cross-sectional view of the block illustrated in FIG. 32 taken along line "B-B".
Figure 35:
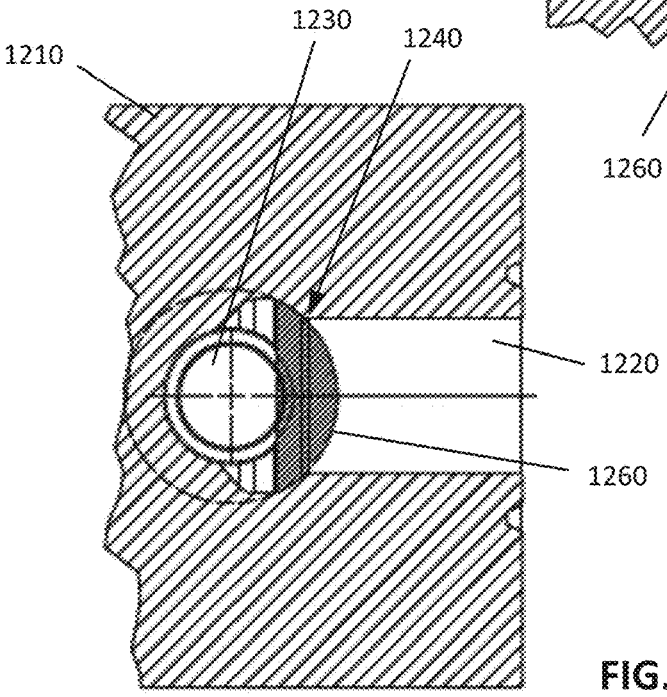
FIG. 35 is a bottom cross-sectional view of the block illustrated in FIG. 32 taken along line "C-C".

FIG. 31 is a top view of block 1200 showing a housing 1210 with a bore 1230. In FIG. 32, bores 1220 and 1230 and the intersection surface 1240 between them are illustrated, all of which are in dashed lines. Referring to FIGS. 33-35, cross-sectional views of block 1200 are shown. Bore 1220 uses hemisphere profile 1260 to define its transition surfaces 1240 and 1250 (see FIGS. 33 and 35). Bore 1230 uses a transition feature 1270 (see FIG. 34) that defines the transition from bore 1230 at the intersection surface 1240.

Figure 36:
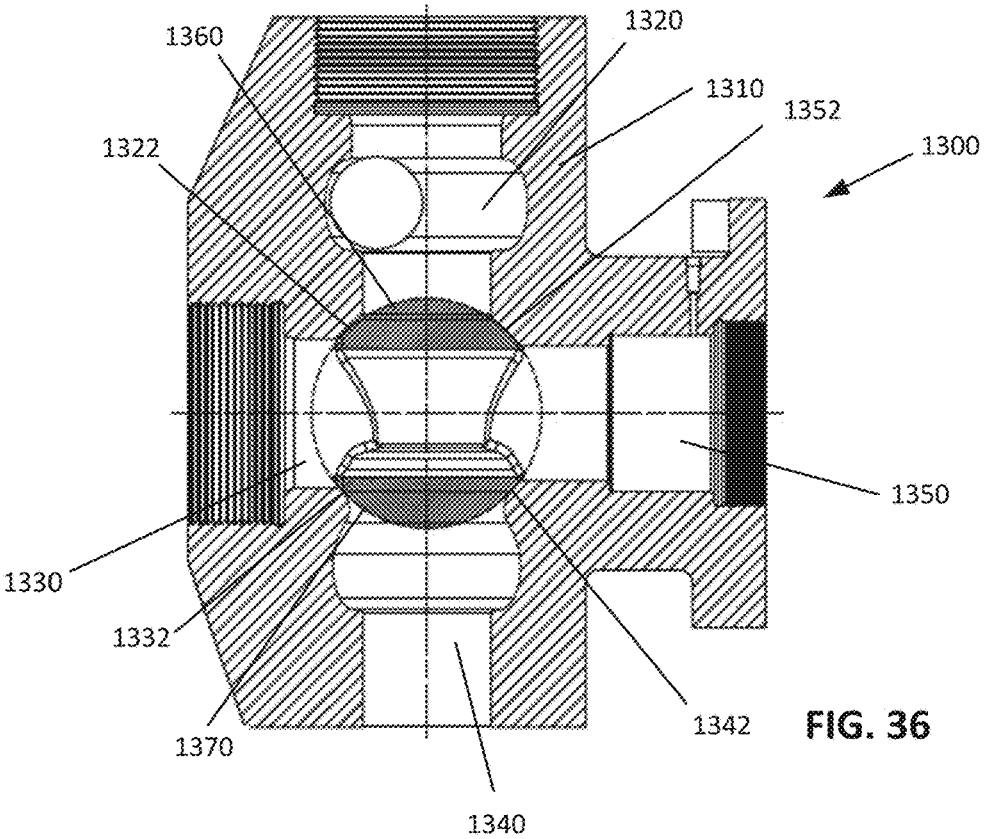
FIG. 36 is a side cross-sectional view of another embodiment of a fluid end according to the present invention taken along a line similar to line "A-A" in FIG. 3.
Figure 37:
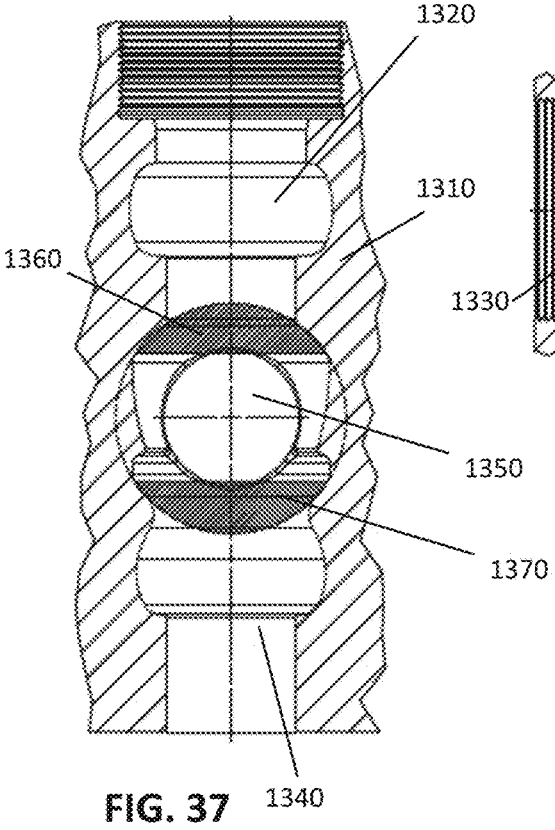
FIG. 37 is a plan cross-sectional view of the fluid end illustrated in FIG. 36 taken along a line similar to line "B-B" in FIG. 4.
Figure 38:
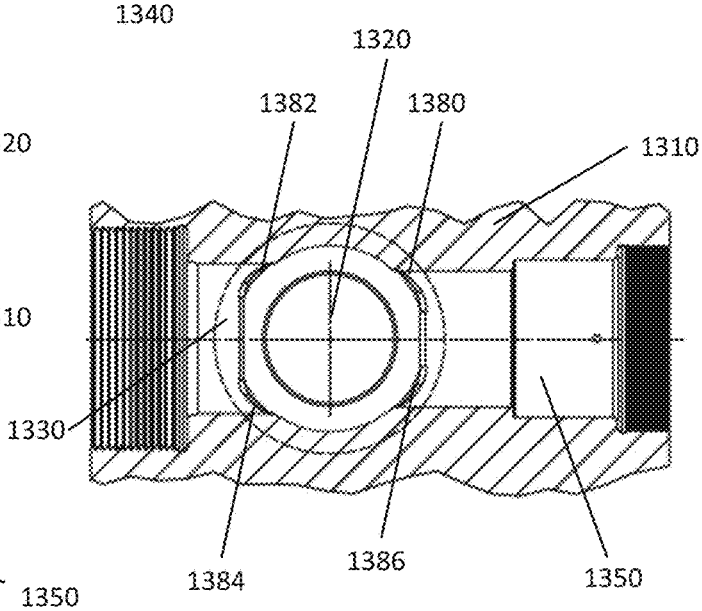
FIG. 38 is a bottom cross-sectional view of the fluid end illustrated in FIG. 36 taken along a line similar to line "C-C" in FIG. 4.

Referring to FIGS. 36-38, another embodiment of a fluid end according to the present invention is illustrated. In this embodiment, fluid end 1300 only uses a hemisphere profile that is blended into the intersecting bore via a hand finish. In an alternative embodiment, the hemisphere profile can be blended via a machine finish. The fluid end 1300 includes a housing 1310 that has several bores 1320, 1330, 1340, and 1350 formed therein. Between bores 1320 and 1330 is a transition surface 1322. Between bores 1330 and 1340 is a transition surface 1332. Between bores 1340 and 1350 is a transition surface 1342. Between bores 1350 and 1360 is a transition surface 1352. In this embodiment, each of the vertical bores 1320 and 1340 includes a hemisphere profile 1360 and 1370, respectively, for its intersecting surfaces. However, as shown in FIG. 38, there is no transition feature that blends the hemisphere profiles 1360 and 1370 to the bores that they overlap. Instead, the transition surfaces from bores 1330 and 1350 are finished radiuses between those bores and the ones that they intersect, either by machine finishing or hand finishing. As is known, hand finishing involves workers using a hand grinder to smooth hard-to-reach areas. Thus, a hand finished transition feature takes more time to form than a machined-in transition feature.

In operation, each plunger reciprocates along the corresponding centerline or axis of each plunger bore 320. As each plunger reciprocates along the plunger bore axis 324, away from the valve cover bore 340, fluid is drawn into each inlet bore 360 through the fluid inlet. Subsequently, the fluid passes into cross-bore intersections 400 along the inlet axes. At this point, each plunger reciprocates along the plunger bore axis 324, toward the valve cover bore 340, which causes the fluid to exit the fluid end 300 of the pump through each discharge bore 380 along axis 384. Specifically, the fluid exits through the fluid outlet disposed within a discharge bore. Each plunger continuously reciprocates along the plunger axes to draw fluid into the fluid end 300 and to eject the fluid from the fluid end 300.

Thus, the invention provides interior surfaces for bores having a geometry to reduce stresses on the fluid of a pump caused by fluidic pressures. The invention minimizes operating stresses in the lower quadrant (or hemisphere) of the cross-bore intersection. The invention improves the fatigue life of the fluid end of the pump. The hemispherical transition surfaces tend to reduce the stress concentration at the cross-bore intersection by smoothing the geometry of the inlet bore and improving the distribution of the load around the cross-bore intersection.

It is to be understood that the invention as described herein can apply to any fluid end block that has at least two intersecting bores. In one embodiment, one of the intersecting bores includes a hemisphere profile for its surfaces, and the other of the two bores include a stepped transition feature.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. For example, a retaining ring or any other component of a retaining assembly shown with one embodiment of a closure element can be used with any desirable closure element to forma closure assembly of the present application. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end of a reciprocating pump, the fluid end comprising:

a housing defining:

a cross-bore;

a first bore;

a second bore, the second bore intersects with the first bore at a first intersection corner, the second bore has a first portion with a first inner surface having a first inner diameter and a second portion with a second inner surface having a second inner diameter, the first inner diameter being smaller than the second inner diameter, the second inner surface of the second portion of the second bore being parallel to the first inner surface of the first portion of the second bore; and a third bore, the third bore intersects with the second bore at a second intersection corner, each of the first bore, the second bore, and the third bore being in fluid communication with the cross-bore, wherein the first intersection corner defines a first transition area having a first surface, the first surface overlaps with a first hemisphere profile located on a top of the cross-bore, the second bore includes a stepped transition feature at the first intersection corner, the stepped transition feature intersects approximately tangentially to the first hemisphere profile, the stepped transition feature includes an angled surface, a first radiused surface located between the angled surface and the first inner surface of the first portion of the second bore, and a second radiused surface located between the angled surface and the second inner surface of the second portion of the second bore, the second inner surface of the second portion of the second bore being located adjacent to the cross-bore, the second inner surface of the second portion of the second bore being closer to the cross-bore than the first inner surface of the first portion of the second bore is to the cross-bore, the angled surface forms part of a cone-shaped bore, and the second intersection corner defines a second transition area having a second surface, the second surface overlaps with a second hemisphere profile located on a bottom of the cross-bore.

2. The fluid end of claim 1, wherein the housing further comprises:

a fourth bore intersecting with the third bore at a third intersection corner, the fourth bore also intersects with the first bore at a fourth intersection corner, the fourth bore is in fluid communication with the cross-bore, wherein the fourth intersection corner defines a fourth transition area having a fourth surface, and the fourth surface overlaps the first hemisphere profile.

3. The fluid end of claim 2, wherein each of the first bore, the second bore, the third bore, and the fourth bore has a centerline, the first hemisphere profile has a center point, and the center point is located at an intersection of the first bore centerline and the second bore centerline and at an intersection of the first bore centerline and the fourth bore centerline.

4. The fluid end of claim 2, wherein the third intersection corner defines a third transition area having a third surface, wherein the third surface overlaps with the second hemisphere profile.

5. The fluid end of claim 4, wherein the second hemisphere profile has a radius, and the radius of the second hemisphere profile intersects each of the second surface and the third surface.

6. The fluid end of claim 5, wherein the radius of the second hemisphere profile is the same as a radius of the first hemisphere profile.

7. The fluid end of claim 5, wherein the radius of the second hemisphere profile is different from a radius of the first hemisphere profile.

8. The fluid end of claim 1, wherein the first hemisphere profile has a radius, and the radius intersects the first surface.

9. The fluid end of claim 1, wherein a spring retainer engages one of the surfaces that overlaps with the second hemisphere profile.

10. The fluid end of claim 1, wherein the first radiused surface is curved and convex, and the second radiused surface is curved and concave.

11. The fluid end of claim 1, wherein the first radiused surface is curved in a first direction, the second radiused surface is curved in a second direction, the second direction being different from and opposite to the first direction.

12. A fluid end of a reciprocating pump, the fluid end comprising:

a housing defining:

a cross-bore;

a first bore;

a second bore, the second bore intersecting with the first bore at a first intersection corner defining a first transition area, the second bore including a stepped transition feature at the first intersection corner, the second bore has a first portion with a first inner surface having a first inner diameter and a second portion with a second inner surface having a second inner diameter, the stepped transition feature includes a radiused transition located between the first and second portions, the radiused transition including an angled surface, a first radiused surface located between the angled surface and the first inner surface of the first portion of the second bore, and a second radiused surface located between the angled surface and the second inner surface of the second portion of the second bore, the first radiused surface being curved and convex, the second radiused surface being curved and concave, the second inner surface of the second portion of the second bore being located adjacent to the cross-bore, the second inner surface of the second portion of the second bore being closer to the cross-bore than the first inner surface of the first portion of the second bore is to the cross-bore, the angled surface forms part of a cone-shaped bore, and the first inner diameter is smaller than the second inner diameter;

a third bore, the third bore intersecting with the second bore at a second intersection corner defining a second transition area; and a fourth bore, the fourth bore intersecting with the third bore at a third intersection corner defining a third transition area, the fourth bore also intersecting with the first bore at a fourth intersection corner defining a fourth transition area, each of the first transition area, the second transition area, the third transition area, and the fourth transition area includes its own surface, wherein each of the first intersection corner, the fourth intersection corner, the first transition area surface, and the fourth transition area surface overlaps with a first hemisphere profile located on a top of the cross-bore, the first hemisphere profile having a first center point, and each of the second intersection corner, the third intersection corner, the second transition area surface, and the third transition area surface overlaps with a second hemisphere profile located on a bottom of the cross-bore, the second hemisphere profile having a second center point, the first center point and the second center point being at the same location in the cross-bore.

13. The fluid end of claim 12, wherein each of the first bore, the second bore, the third bore, and the fourth bore has a centerline, the first center point is located at an intersection of the first bore centerline and the second bore centerline and at an intersection of the first bore centerline and the fourth bore centerline, and the second center point is located at an intersection of the second bore centerline and the third bore centerline and at an intersection of the third bore centerline and the fourth bore centerline.

14. The fluid end of claim 12, wherein the first hemisphere profile has a first radius and the second hemisphere profile has a second radius, and the first radius is equal to the second radius.

15. The fluid end of claim 12, wherein each of the first bore, the second bore, the third bore, and the fourth bore is in fluid communication with the cross-bore, the first hemisphere profile has a first radius, the second hemisphere profile has a second radius, the first radius is smaller the second radius, and the first hemisphere profile is smaller than the second hemisphere profile.

16. The fluid end of claim 15, wherein the second inner surface of the second portion of the second bore is parallel to the first inner surface of the first portion of the second bore.

17. A reciprocating pump, comprising:

a housing defining:

a cross-bore;

a first bore;

a second bore, the second bore intersecting with the first bore at a first intersection corner defining a first transition area, the second bore including a stepped transition feature at the first intersection corner, the second bore has a first portion with a first inner surface having a first inner diameter and a second portion with a second inner surface having a second inner diameter, the second inner surface of the second portion of the second bore being parallel to the first inner surface of the first portion of the second bore, the stepped transition feature includes a radiused transition located between the first and second portions, the radiused transition including an angled surface, a first radiused surface located between the angled surface and the first inner surface of the first portion of the second bore, and a second radiused surface located between the angled surface and the second inner surface of the second portion of the second bore, the second inner surface of the second portion of the second bore being located adjacent to the cross-bore, the second inner surface of the second portion of the second bore being closer to the cross-bore than the first inner surface of the first portion of the second bore is to the cross-bore, the angled surface forms part of a cone-shaped bore, and the first inner diameter is smaller than the second inner diameter;

a third bore, the third bore intersecting with the second bore at a second intersection corner defining a second transition area;

a fourth bore, the fourth bore intersecting with the third bore at a third intersection corner defining a third transition area, the fourth bore also intersecting with the first bore at a fourth intersection corner defining a fourth transition area, each of the first bore, the second bore, the third bore, and the fourth bore is in fluid communication with the cross-bore, the cross-bore having a top side and a bottom side, wherein the first transition area and the fourth transition area overlap a first hemisphere profile that is located on the top side of the cross-bore, and the second transition area and the third transition area overlap a second hemisphere profile that is located on the bottom side of the cross-bore; and a plunger reciprocally movable in the second bore of the housing.

18. The reciprocating pump of claim 17, wherein a radius of the second hemisphere profile is different from a radius of the first hemisphere profile.

19. The reciprocating pump of claim 17, wherein the first hemisphere profile has a first center point, the second hemisphere profile has a second center point, the first center point and the second center point are at the same location in the cross-bore, each of the first bore, the second bore, the third bore, and the fourth bore has a centerline, the first center point is located at an intersection of the first bore centerline and the second bore centerline and at an intersection of the first bore centerline and the fourth bore centerline, and the second center point is located at an intersection of the second bore centerline and the third bore centerline and at an intersection of the third bore centerline and the fourth bore centerline.

20. The reciprocating pump of claim 17, wherein the first radiused surface is curved and convex, and the second radiused surface is curved and concave.

* * * * *